US006371299B1

(12) United States Patent
Essary

(10) Patent No.: US 6,371,299 B1
(45) Date of Patent: Apr. 16, 2002

(54) CRATE ASSEMBLY AND IMPROVED METHOD

(75) Inventor: Mark S. Essary, Laurel, MS (US)

(73) Assignee: Howard Industries, Laurel, MS (US)

( * ) Notice: Subject to any disclaimer, the term of this patent is extended or adjusted under 35 U.S.C. 154(b) by 0 days.

(21) Appl. No.: 09/556,501

(22) Filed: Apr. 24, 2000

(51) Int. Cl.[7] ..... B65D 19/00

(52) U.S. Cl. ..... 206/600; 206/319; 53/244; 220/1.5

(58) Field of Search ..... 206/386, 600, 206/319, 335, 701, 722; 53/244, 245, 443, 448; 108/53.1, 55.1, 55.3; 220/1.5, 4.28

(56) References Cited

U.S. PATENT DOCUMENTS

| | | | | |
|---|---|---|---|---|
| 2,692,064 A | | 10/1954 | Koester | |
| 3,372,855 A | | 3/1968 | Smith | |
| 3,557,855 A | | 1/1971 | Weingarten | |
| 3,832,956 A | * | 9/1974 | Briel, Jr. | 108/55.1 |
| 4,124,119 A | * | 11/1978 | Nordstrom | 206/600 |
| 4,467,922 A | | 8/1984 | Rowley | |
| 4,538,663 A | * | 9/1985 | Looker | 220/1.5 |
| 4,614,277 A | | 9/1986 | Fourie | |
| 4,830,211 A | * | 5/1989 | Efird | 206/600 |
| 4,836,395 A | * | 6/1989 | Goutille | 220/1.5 |
| 5,058,747 A | | 10/1991 | Decroix et al. | |
| 5,069,338 A | | 12/1991 | Grisby | |
| 5,292,012 A | * | 3/1994 | Davis et al. | 220/1.5 |
| 5,413,224 A | | 5/1995 | Marron et al. | |
| 5,501,334 A | | 3/1996 | Przytulla et al. | |
| 5,507,392 A | | 4/1996 | Schutz | |
| 5,794,782 A | | 8/1998 | Ascik | |
| 5,938,037 A | | 8/1999 | Essary | |

* cited by examiner

*Primary Examiner*—Luan K. Bui
(74) *Attorney, Agent, or Firm*—Townsend and Townsend and Crew LLP

(57) ABSTRACT

A crate assembly having a base, a first support member secured to the base and having a first shelf and a second support member secured to the base and having a second shelf. The crate assembly additionally includes a third support member secured to the base and having a third shelf and a fourth corner support member secured to the base and having a fourth shelf. A generally centric support member is secured to the base and includes a structure defining at least one generally centric shelf. A first brace assembly is connected to the first support member and a second brace assembly is connected to the fourth support member. A connecting assembly is releasably engaged to the first brace assembly and to the second brace assembly. A container assembly including the crate assembly supporting a pallet. A method is provided for transporting transformers with the crate assembly.

17 Claims, 40 Drawing Sheets

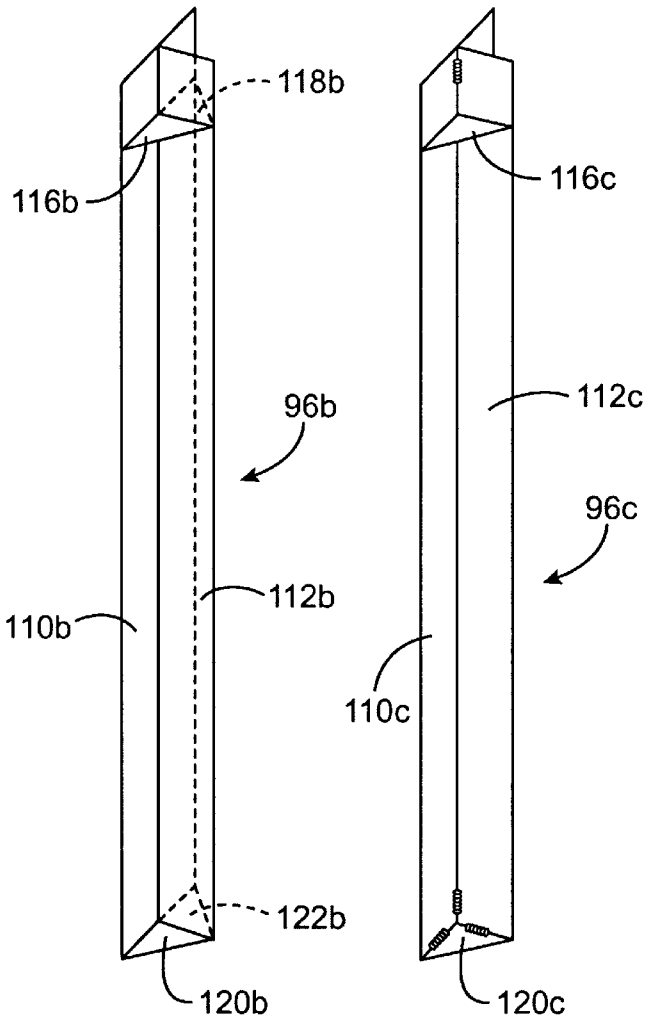
FIG. 32
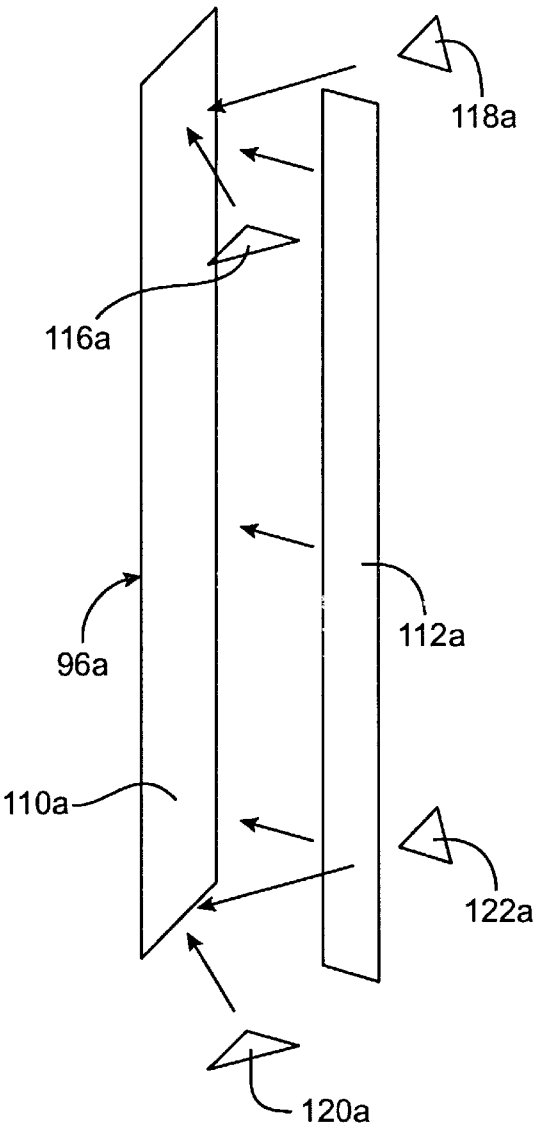

CRATE ASSEMBLY AND IMPROVED METHOD

BACKGROUND OF THE INVENTION

1. Field of the Invention

The present invention relates to an improved crate assembly that is capable of employing more than two (2) pallets (e.g. four (4) or eight (8) pallets, etc.) for transporting articles of commerce. More specifically, the present invention provides an improved container assembly including an improved crate assembly and method for transporting articles of commerce, such as transformers and the like.

2. Description of the Prior Art

A patentability investigation was conducted and the following U.S. Patents were discovered: U.S. Pat. No. 2,692,064 to Koester; U.S. Pat. No. 3,372,855 to Smith; U.S. Pat. No. 3,557,855 to Weingarten; U.S. Pat. No. 4,467,922 to Rowley; U.S. Pat. No. 4,614,277 to Fourie et al.; U.S. Pat. No. 5,058,747 to Decroix et al.; U.S. Pat. No. 5,069,338 to Gigsby; U.S. Pat. No. 5,501,334 to Przytulla et al.; and U.S. Pat. No. 5,507,392 to Schutz.

U.S. Pat. No. 2,692,064 to Koester, teaches a shipping container for the storage and the transportation of articles. The container has a pair of straps such that each end and side section of the container is individually braced.

U.S. Pat. No. 3,372,855 to Smith, teaches a reinforced container having metal bands secured to the container and the pallet.

U.S. Pat. No. 3,557,855 to Weingarten, teaches a rectangular collapsed double mail carrier having a pair of cable members which limit the outward movement of the end panels.

U.S. Pat. No. 4,467,922 to Rowley, teaches a container for shipping glass sheets. The container includes elongated tensions members which increases the glass supporting strength of the container.

U.S. Pat. No. 4,614,277 to Fourie et al., teaches a pallet having posts secured thereto. Each post is positioned between the ends of a respective wall. The posts are joined to one another by strips of a laminated paper material such as that which is used to form the so-called slip sheet of an unpalletized loaded.

U.S. Pat. No. 5,058,747 to Decroix et al., teaches a transport and storage container. The container is provided with pallet feet so it can be handled by a fork-lift truck.

U.S. Pat. No. 5,069,338 to Gigsby, teaches a reinforced corrugated container. U.S. Pat. No. '338 more particularly teaches a support pad of semi-rigid material for protecting contents of corrugated containers, and a pallet having a plurality of sockets with each socket receiving a vertical cleat attached to the corrugated container.

U.S. Pat. No. 5,501,334 to Przytulla et al., teaches a pallet container for storage and transport of liquid contents. The container includes an inner container of thermoplastic material and a support jacket.

U.S. Pat. No. 5,507,392 to Schutz, teaches a pallet container which may be used for the transport and storage of liquids. The container has an outer jacket made of criss-crossing vertical and horizontal lattice bars. The container contains an inner container. The inner container, along with a support insert storage and the outer jacket, are supported by a steel pallet. The steel pallet contains a storage space for the outer jacket and the support insert in a collapsed state.

None of the foregoing prior art teaches a crate assembly which is capable of shipping articles of commerce and being quickly disassembled in a period of time that is desired by today's shippers and receivers. Therefore, what is needed and what has been invented is an improved crate assembly that is capable of employing more than two (2) pallets (e.g., four (4) or eight (8) pallets) for transporting articles of commerce. What is further needed and what has been invented is an improved method for transporting articles of commerce, such as transformers and the like.

SUMMARY OF THE INVENTION

An embodiment of the present invention provides a container assembly comprising a base; a first support member secured to the base and having a structure defining a first shelf; and a second support member secured to the base and having a structure defining a second shelf. The container assembly also includes a third support member secured to the base and having a structure defining a third shelf and a fourth support member secured to the base and having a structure defining a fourth shelf. A generally centric support member is secured to the base and has a structure defining at least one generally centric shelf. A first brace member (e.g. a first generally V-shaped brace member) is connected to the first support member and a second brace member (e.g. a second generally V-shaped brace member) is connected to the fourth support member. A connector assembly is releasably attached to the first brace member and to the second brace member for placing tension on the first brace member and on the second brace member; and a pallet is supported by the base. The container assembly preferably additionally comprises a third and fourth brace member (e.g. a third and fourth generally V-shaped brace members) respectively secured to the third and fourth brace member, and another or second connector assembly releasably attached to the third and fourth brace members for placing tension on same. Therefore, a preferred embodiment of the invention may be one set of a pair of tension V-shaped brace assemblies and a connector assembly for placing tension on same, or two opposed sets of same; that is a first pair of tension V-shaped brace assemblies and a first connector assembly for placing tension on the first two V-shaped brace assemblies and a second pair of tension V-shaped brace assemblies and a second connector assembly for placing tension on the second two V-shaped brace assemblies. The container assembly additionally preferably comprises at least one intermediate support member secured to the base and having a structure defining at least one intermediate shelf. The pallet supported by the base comprises the pallet disposed on one of the first, second, third and fourth shelves and on one of the at least one generally centric shelf. The pallet supported by the base may also comprise the pallet disposed on the base. The generally centric support member includes the structure defining a first centric shelf, a second centric shelf, a third centric shelf, and a fourth centric shelf.

The immediate foregoing container assembly additionally comprises a first intermediate support member secured to the base between the first support member and the second support member, a second intermediate support member secured to the base between the second support member and the third support member a third intermediate support member secured to the base between the third support member and the fourth support member, and a fourth intermediate support member secured to the base between the fourth support member and the first support member. Each intermediate support member preferably comprises an upper intermediate shelf. The pallet supported by the base in another embodiment of the invention comprises the pallet disposed on the upper intermediate shelf of the intermediate support member and on the first shelf of the first support member and on the generally centric shelf of the generally centric support member. Each intermediate support member also preferably comprises a lower intermediate shelf. In another embodiment of the invention the pallet supported by the base comprises the pallet disposed on the first lower intermediate shelf of the first intermediate support member and on the second lower intermediate shelf of the second intermediate support member. The present invention also provides a crate assembly comprising the container assembly without a pallet.

The present invention further provides a method for transporting transformers comprising the steps of:

a) providing a pallet;

b) providing a crate assembly having a first support member with a first shelf and a first tension brace assembly connected thereto, a second support member with a second tension brace assembly connected thereto, a generally centric support member having a centric shelf and an intermediate support member having an intermediate shelf;

c) positioning a transformer on the pallet;

d) disposing the pallet on the first shelf of the first support member, on the centric shelf of the generally centric support member, and on the intermediate shelf of the intermediate support member;

e) placing tension on the first tension brace assembly and on the second tension brace assembly while simultaneously compressing the pallet of step (d) between the first support member and the intermediate support member to form a container assembly comprising the pallet and the transformer positioned on the pallet; and f) transporting the container assembly of step (e) to a desired destination.

The present invention also provides a crate assembly comprising a base, a first support member secured to the base and having a structure defining a first shelf; and a second support member secured to the base and having a structure defining a second shelf. A third support member is secured to the base and has a structure defining a third shelf; and a fourth support member is secured to the base and includes a structure defining a fourth shelf. At least one intermediate support member is secured to the base and includes a structure defining at least one intermediate shelf. A first brace assembly is connected to the first support member and a second brace assembly is connected to the second support member. A connector is releasably attached to the first brace assembly and to the second brace assembly for placing tension on the first brace assembly and on the second brace assembly. This embodiment of the invention may also employ another set of first and second brace assemblies and connector for placing tension on same.

Another embodiment of the present invention accomplishes its desired objects by broadly providing a method for transporting transformers comprising the steps of:

a) providing a first pallet and a second pallet;

b) providing a crate assembly having a first corner support member with a first tension brace assembly connected thereto and a second corner support member with a second tension brace assembly connected thereto;

c) positioning a first transformer on the first pallet;

d) disposing the crate assembly on the first pallet;

e) positioning a second transformer on the second pallet;

f) disposing the second pallet of step (e) on the crate assembly of step (d);

g) placing tension on the first tension brace assembly and on the second tension brace assembly while simultaneously compressing the second pallet of step (f) between the first corner support member and the second corner support member to form a container assembly comprising the first pallet, the first transformer positioned on the first pallet, the crate assembly supported by the first pallet, the second pallet supported by the crate assembly, and the second transformer positioned on the second pallet; and h) transporting the container assembly of the step (g) to a desired destination.

The foregoing method preferably additionally comprises elevating the container assembly of step (g) prior to the transporting step (h). The placing step (g) includes pulling the first tension brace assembly and the second tension brace assembly towards each other. The first tension brace assembly and the second tension brace assembly respectively include a first base plate and a second base plate; and during and/or after the placing step (g), the first base plate and said second base plate are spaced from each other. The method additionally comprises releasing the tension on the first tension brace assembly and on the second tension brace assembly by removing the second pallet from the crate assembly; and bending the first tension brace assembly and the second tension brace assembly respectively away from the first corner support member and from the second corner support member. The method further preferably additionally comprises pivoting the crate assembly off of the first pallet; more specifically, pivoting the crate assembly approximately 90 degrees to remove the crate assembly from the first pallet. The first corner support member and the second corner support member respectively comprise a first upper shelf and a second upper shelf; and the disposing step (f) comprises disposing the second pallet of step (e) on the first upper shelf and on the second upper shelf. The first corner support member and the second corner support member also respectively comprise a first lower shelf and a second lower shelf; and the disposing step (d) comprises disposing the first lower shelf and the second lower shelf on the first pallet. The method also further preferably additionally comprises coupling a connector assembly to the first tension brace assembly and to the second tension brace assembly; and the placing step (g) comprises tightening the connector assembly.

An embodiment of the present invention also accomplishes its desired objects by broadly providing a crate assembly comprising a first support member having a structure defining a first upper shelf; and a second support member having a structure defining a second upper shelf. A third support member is provided with a structure defining a third upper shelf. The crate assembly additionally comprises a fourth support member having a structure defining a fourth upper shelf. A first brace assembly is connected to the first support member and to the second support member, and a second brace assembly is connected to the second support member and to the third support member. A third brace assembly is included for being connected to the third support member and to the fourth support. A first V-shaped brace assembly and a second V-shaped brace assembly is respectively connected to the first support member and to the fourth support member.

The crate assembly further comprises a connecting means, releasably attached to the first V-shaped brace assembly and to the second V-shaped brace assembly, for being mechanically tightened to an extent of not being capable of being manually disconnected after a pallet structure is placed on the first shelf, the second shelf, the third shelf and on the fourth shelf and the connecting means is tightened to compress the pallet structure between the first support member and the second support member, and for being manually disconnected from the first V-shaped brace assembly after the pallet structure is removed from the first shelf, the second shelf, the third shelf and the fourth shelf of the first support member, the second support member, third support member, and the fourth support member, respectively. A container assembly is formed when the crate assembly is supported by a first or lower pallet and when a second or upper pallet is supported by the crate assembly.

It is therefore an object of the present invention to provide an improved method for transporting transformers.

It is another object of the present invention to provide an improved crate assembly.

These, together with the various ancillary objects and features which will become apparent to those skilled in the art as the following description proceeds, are attained by these novel assemblies and methods, a preferred embodiment thereof shown with reference to the accompanying drawings, by way of example only, wherein:

BRIEF DESCRIPTION OF THE DRAWINGS

FIG. 32 is a perspective view of an intermediate or side support member;

DESCRIPTION OF THE EMBODIMENTS

Figure 1A:
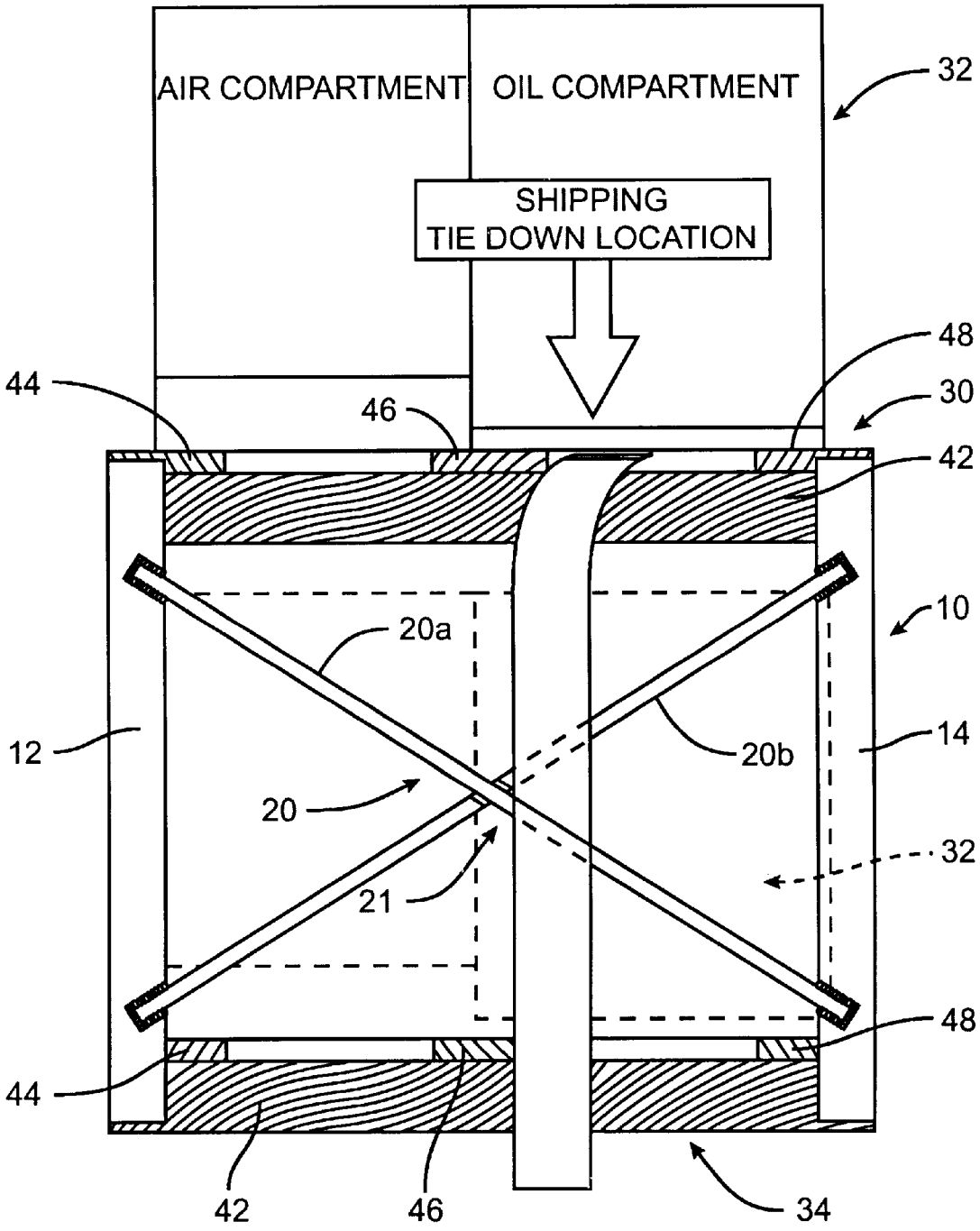
FIG. 1A is a side elevational view of the crate assembly supported by a lower pallet and having corner support members with upper shelves which are supporting an upper pallet.

Referring in detail now to the drawings wherein similar parts of the invention are identified by like reference numerals, there is seen a crate assembly, generally illustrated as 10, having corner support members 12, 14, 16 and 18 which are manufactured from any suitable strong and sturdy material, such as iron, steel or similar metal or metallic alloy. Comer support members 12 and 14 (see FIG. 1A) are coupled or interconnected together by a brace assembly 20. Similarly, corner support members 14 and 16 and corner support members 16 and 18 are also coupled or interconnected together by brace assemblies 22 and 24, respectively (see FIGS. 1B and 1C). As best shown in FIG. 2, corner support member 18 has a tension brace assembly 26 secured thereto. Comer support member 12 has a similar tension brace assembly 28 bound thereto. Tension brace assemblies 26 and 28 are essentially mirror images of each other and are interconnected by a connecting assembly, generally illustrated as 29, when the crate assembly 10 is used for crating and shipping purposes.

Each of the corner support members 12, 14, 16 and 18 is preferably an angle iron member or a right triangle member in horizontal cross section. The corner support members 12, 14, 16 and 18 have an upper structure which functions to support an upper pallet, generally illustrated as 30. Typically, the upper pallet 30 will support an article 32 of commerce, such as transformers and the like. Each of the corner members 12, 14, 16 and 18 also have a lower structure for engaging a lower pallet, generally illustrated as 34, to maintain the crate assembly 10 (including the corner support members 12, 14, 16 and 18) in a generally upright or vertical posture when being used for transporting or shipping articles 32 of commerce with the pallets 30 and 34. More specifically and as best shown in FIG. 1D, the upper structure of each corner support members 12, 14, 16 and 18, respectively, include upper shelves 12*a*, 14*a*, 16*a* and 18*a* for supporting the upper pallet 30 and any associated article 32 of commerce. More specifically further and as best shown in FIG. 1E, the lower structure of each corner support members 12, 14, 16 and 18, respectively, include lower shelves 12*b*, 14*b*, 16*b*, and 18*b* for resting upon or being supported by the lower pallet 34 (see FIGS. 1B and 1E). Upper shelves 12*a*, 16*a* and 18*a* would have the same front elevational view as upper shelve 14*a* in FIG. 1F. Likewise, lower shelves 12*b*, 16*b* and 18*b* would have the same front elevational view as lower shelve 14*b* in FIG. 1G. Upper shelves 12*a*, 14*a*, 16*a* and 18*a* as well as lower shelves 12*b*, 14*b*, 16*b* and 18*b* all have a right triangle geometric shape with respect to a top plan view (see FIGS. 1D and 1E), and are all preferably manufactured of a strong, sturdy material, preferably one (e.g. iron, steel or the like) that makes a strong metallic bond with the respective corner support members 12, 14, 16 and 18.

Figure 1B:
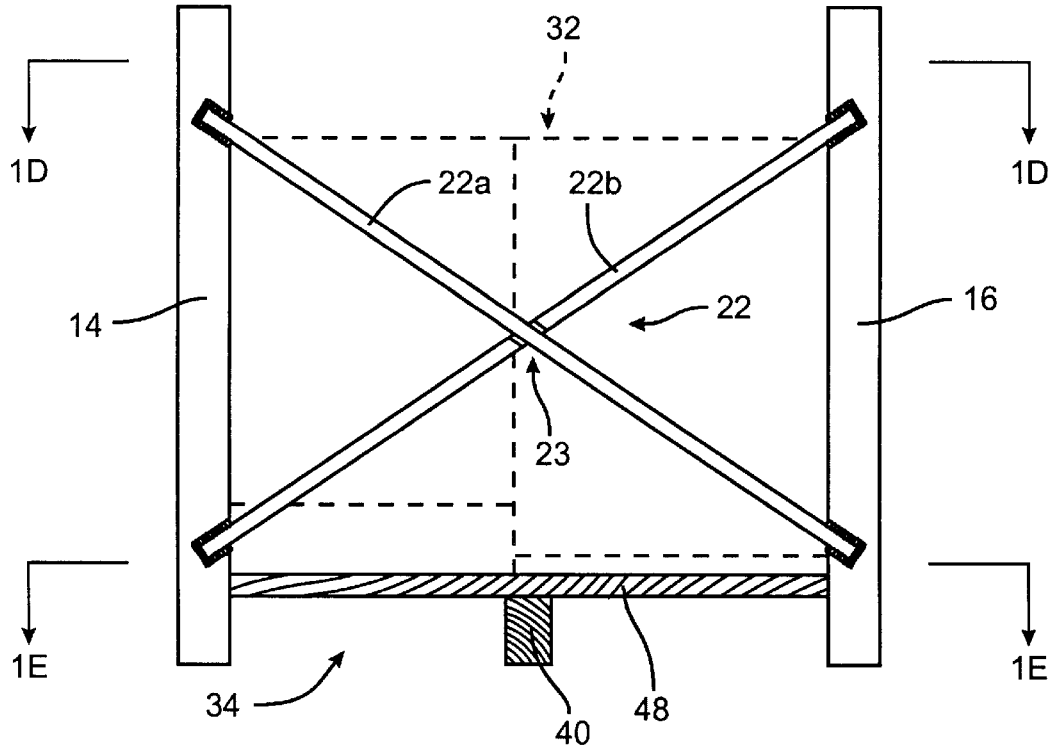
FIG. 1B is a side elevational view of the crate assembly being supported by the lower pallet.
Figure 1C:
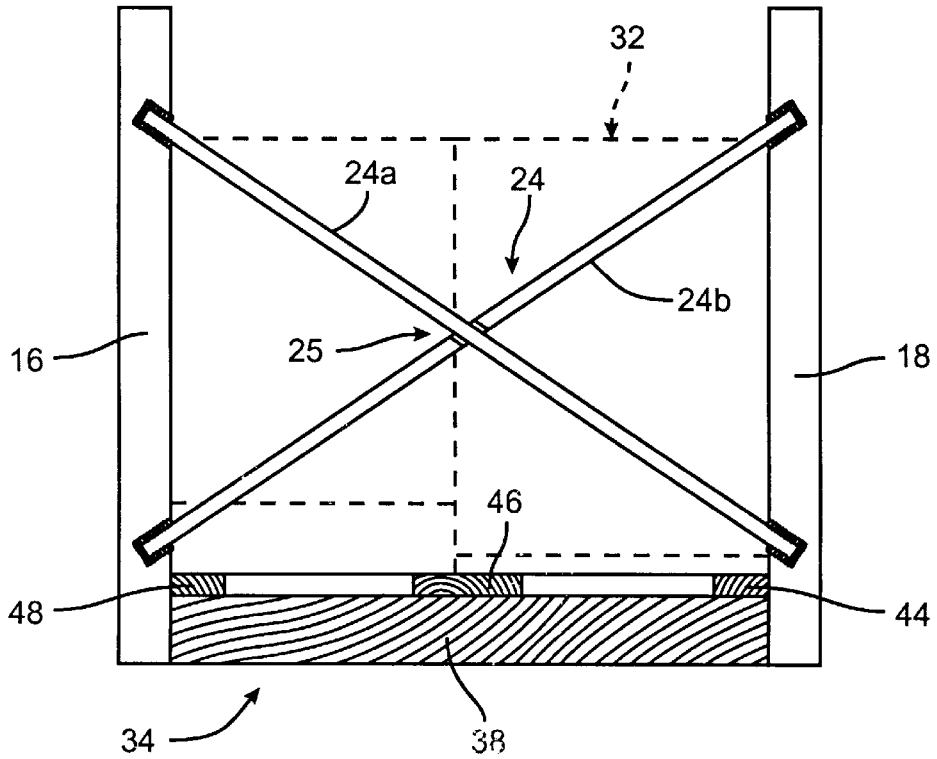
FIG. 1C is a side elevational view of another side of the crate assembly being supported by the lower pallet.
Figure 1D:
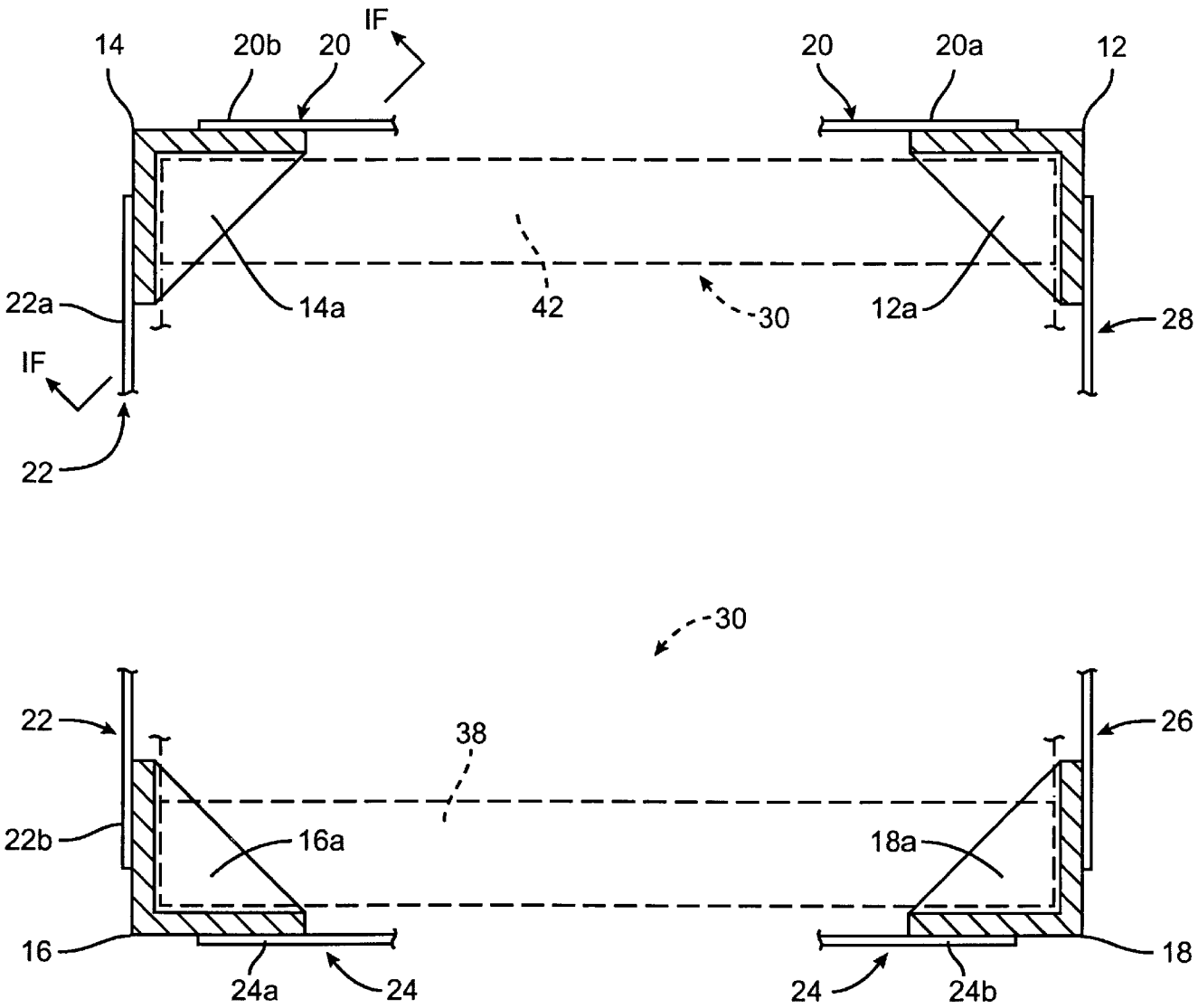
FIG. 1D is a horizontal sectional view taken in direction of the arrows and along the plane of line 1D—1D in FIG. 1B.
Figure 1E:
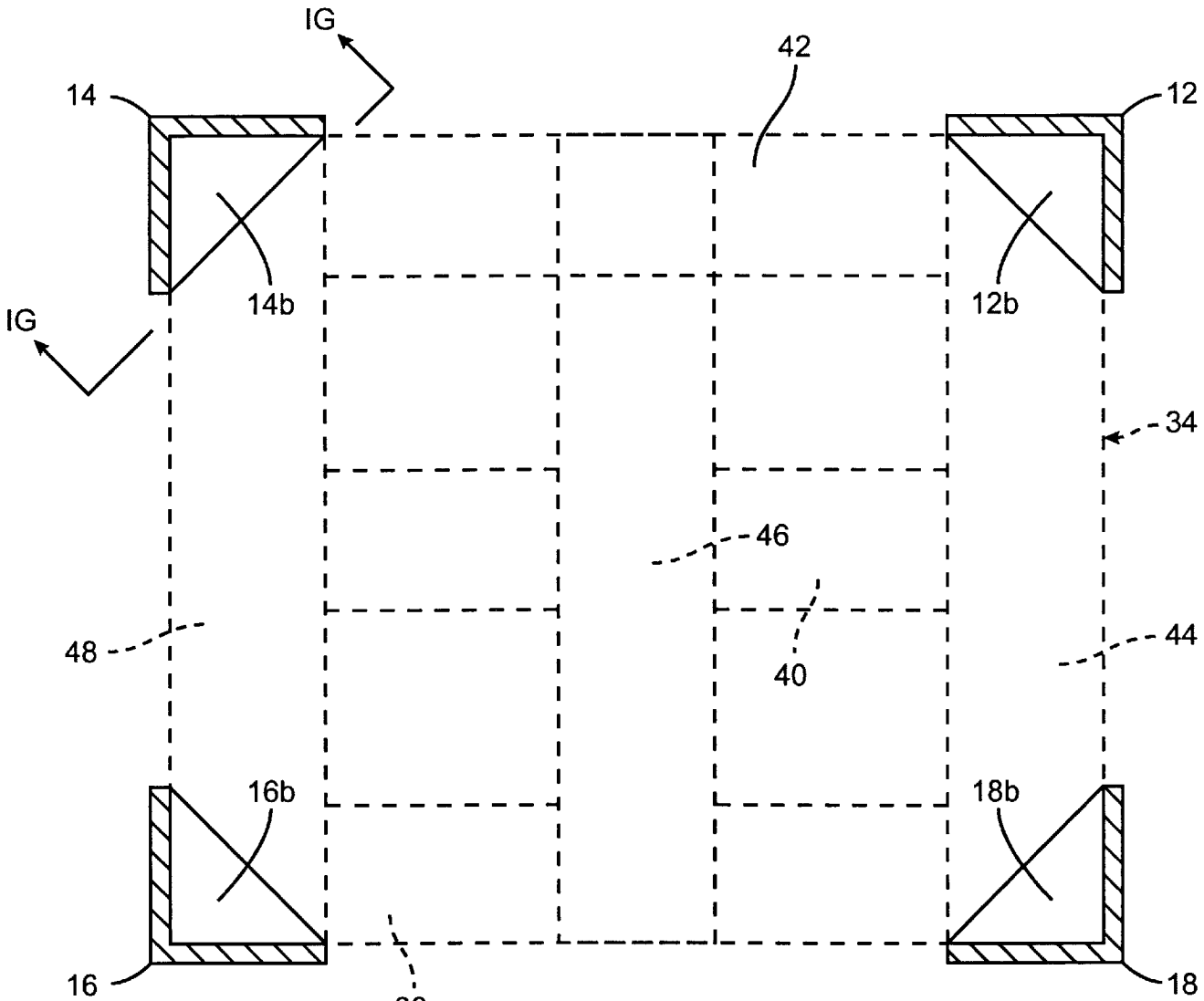
FIG. 1E is a horizontal sectional view taken in direction of the arrows and along the plane of line 1E—1E in FIG. 1B.
Figure 1F:
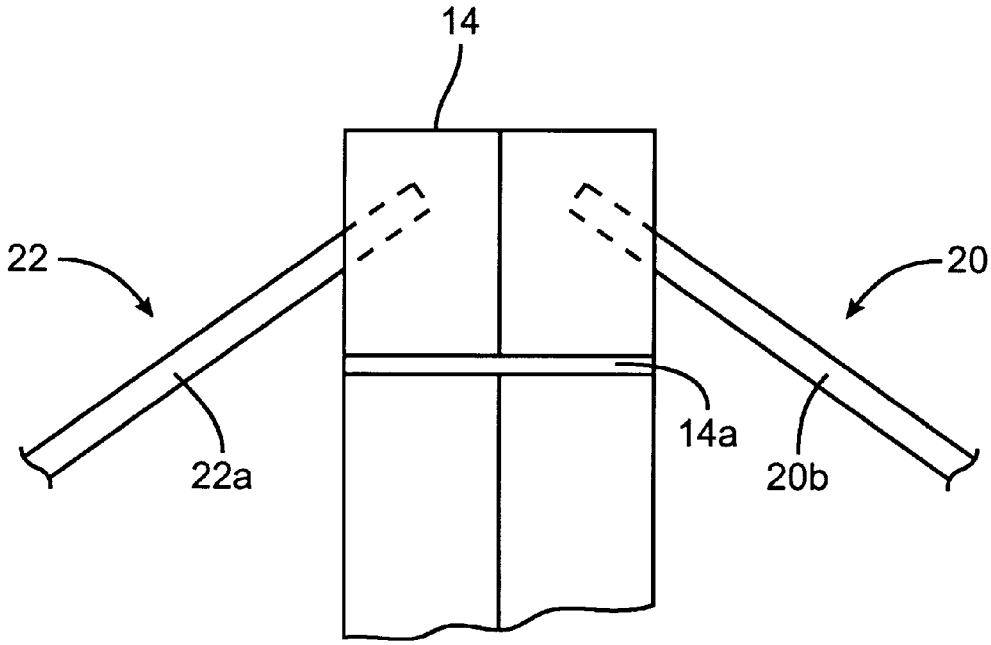
FIG. 1F is a partial vertical sectional view taken in direction of the arrows and along the plane of line 1F—1F in FIG. 1D.
Figure 1G:
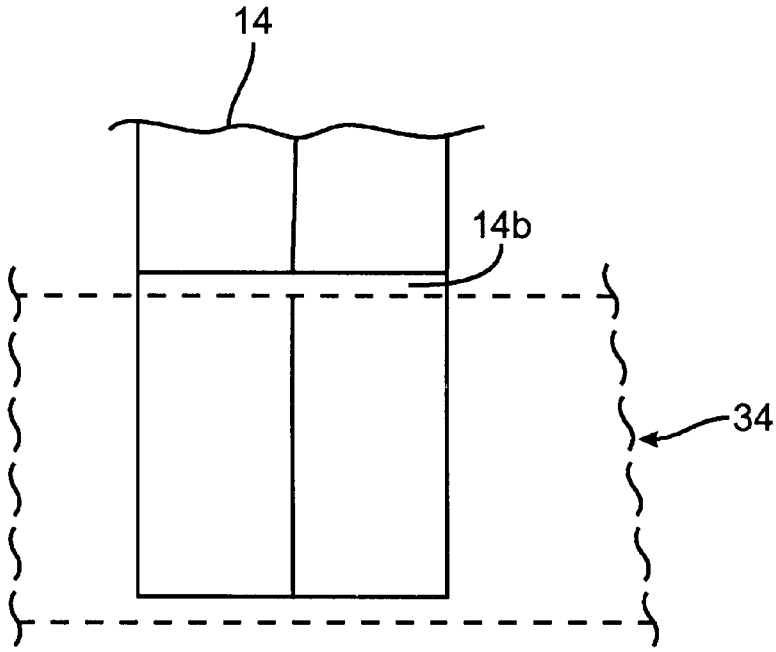
FIG. 1G is a partial vertical sectional view taken in direction of the arrows and along the plane of line 1G—1G in FIG. 1E.
Figure 2:
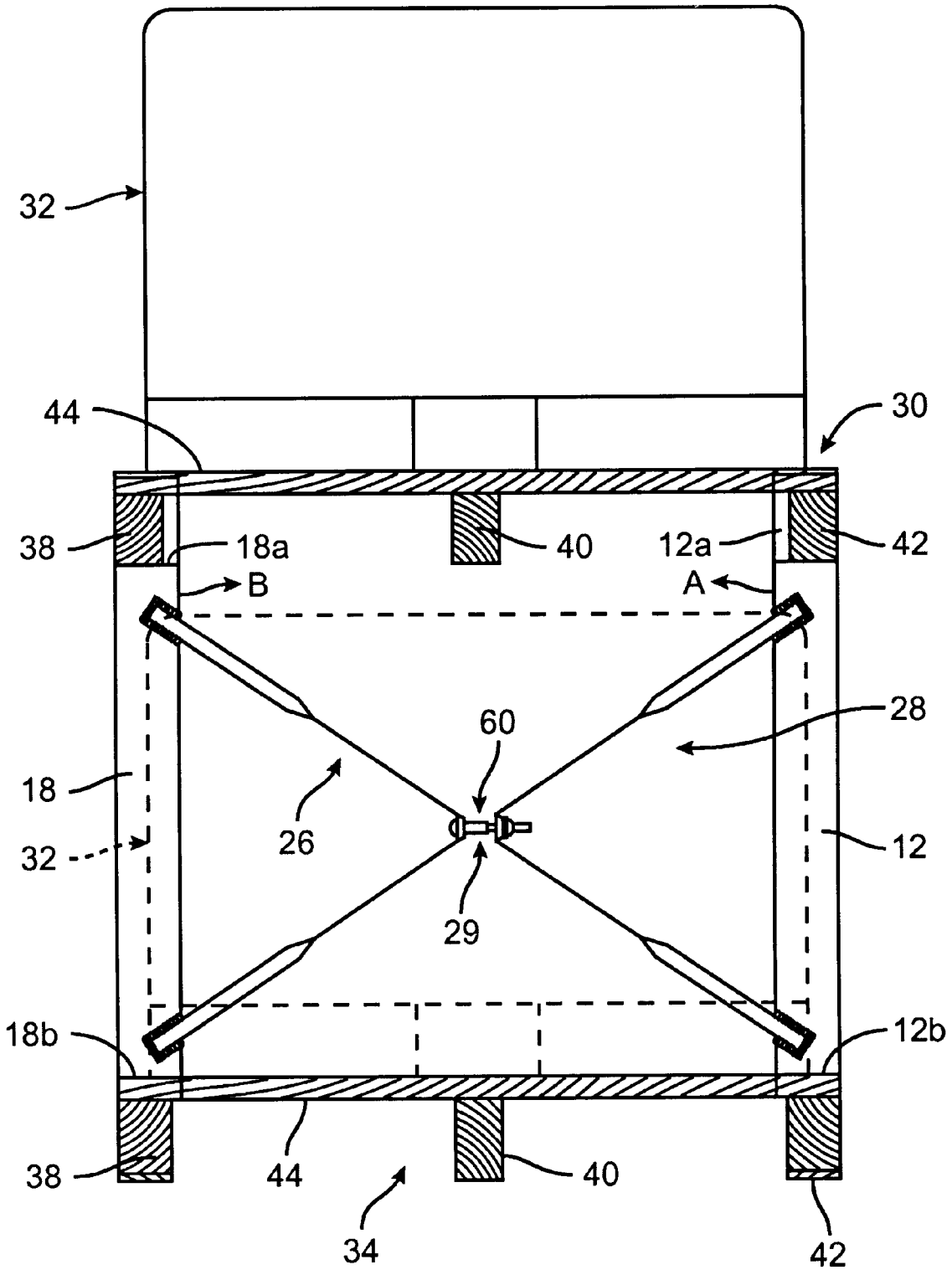
FIG. 2 is a front elevational view of the crate assembly being supported by the lower pallet and having corner support members with upper shelves supporting an upper pallet and further having a pair of tension brace assemblies connected to a pair of front corner support members.
Figure 3:
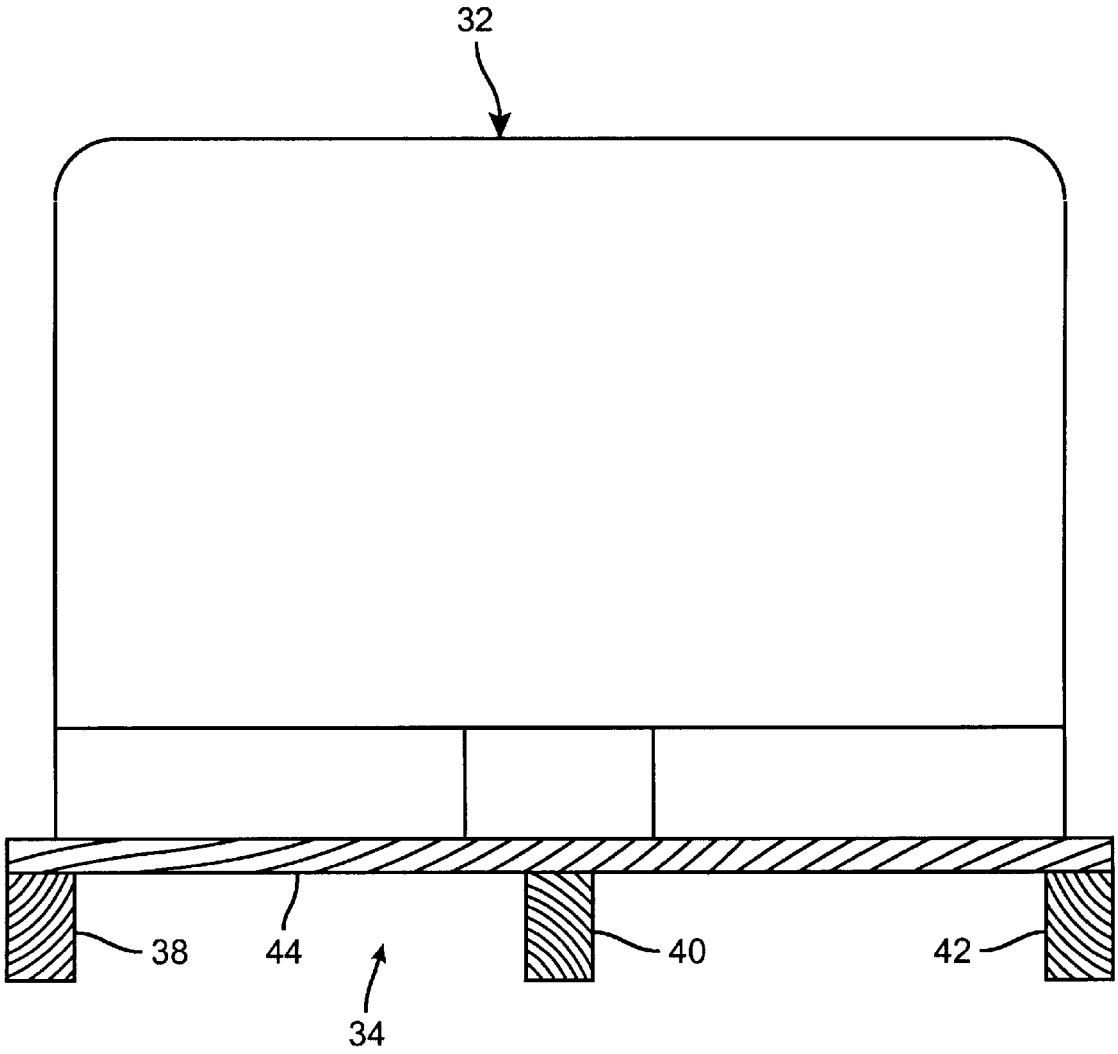
FIG. 3 is a front elevational view of the upper pallet supporting an article of commerce, more specifically a transformer.
Figure 4:
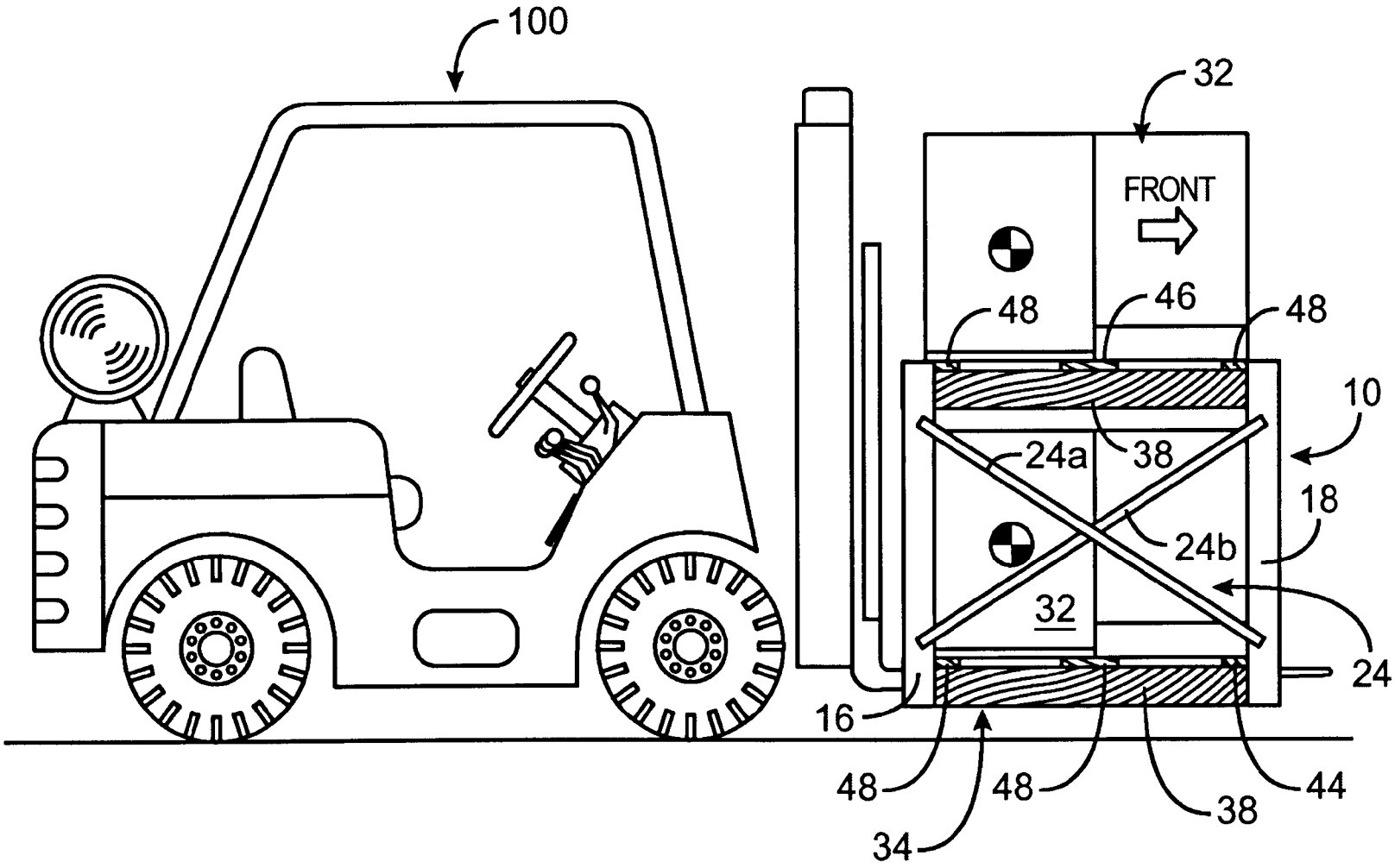
FIG. 4 is a side elevational view of a fork lift vehicle engaged to the lower pallet and carrying a container assembly which superimposedly comprises the lower pallet, the crate assembly supported by the lower pallet, and the upper pallet which is being supported by the corner support members of the crate assembly.
Figure 5:
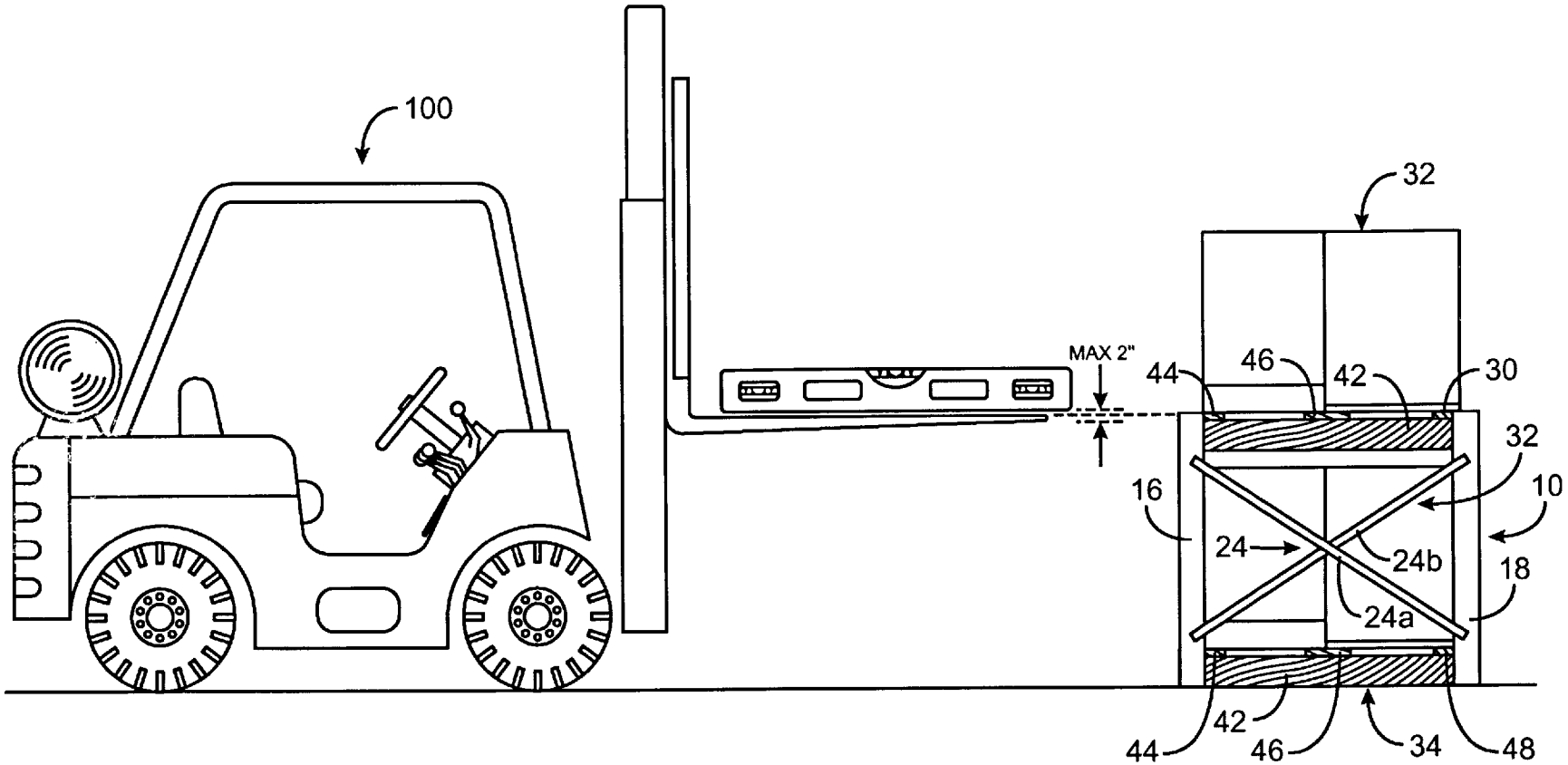
FIG. 5 is the side elevational view of the fork lift vehicle of FIG. 4 after the fork lift has disposed of the container assembly on the floor and with the fork lift members of the fork lift vehicle in the process being aligned with the upper pallet of the container assembly.
Figure 6:
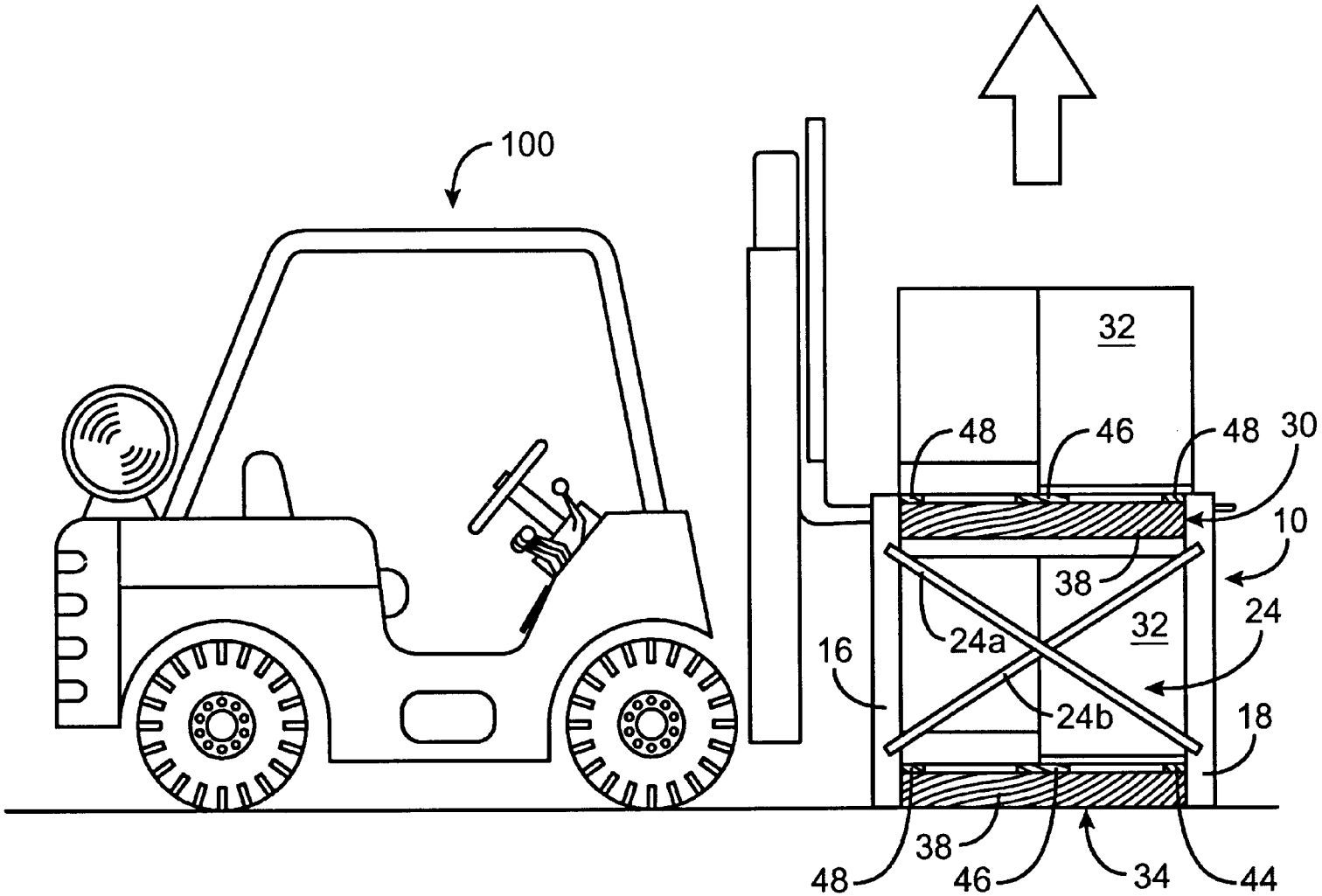
FIG. 6 is the side elevational view of the fork lift vehicle of FIG. 5 after the fork lift vehicle has moved forward such that the fork lift members of the fork lift vehicle have become engaged with the upper pallet.

Pallets 30 and 34 are conventional pallets of well known construction consisting of main support members or longitudinally extending parallel skids 38, 40 and 42 (see FIG. 2) joined or coupled together by transverse parallel floor planks 44, 46 and 48 (see FIG. 1A). Two of the longitudinally extending parallel skids (i.e. outer parallel skids 38 and 42) would engage and be supported by the upper surface of upper shelves 12*a*, 14*a*, 16*a* and 18*a*. Similarly, two of the transverse parallel floor planks (i.e. outer parallel floor planks 44 and 48) would engage the lower surface of lower shelves 12*b*, 14*b*, 16*b* and 18*b* to support the crate assembly 10 including the corner support members 12, 14, 16 and 18 in an upright generally vertical position. More particularly and as shown in FIGS. 1A, 1D and 2, the upper surface of upper shelves 12*a* and 14*a* and the upper surface of upper shelves 16*a* and 18*a*, respectively, contact and support outer parallel skids 42 and 38. More particularly further and as shown in FIGS. 1A, 1E and 2, the lower surface of lower shelves 12*b* and 18*b* and the lower surface of lower shelves 14*b* and 16*b*, respectively, contact outer parallel floor planks 44 and 48.

The brace assemblies 20, 22 and 24 are each preferably a pair of connected criss-crossing members. As best shown in FIG. 1A, brace assembly 20 includes criss-crossing members 20*a* and 20*b* which are connected to each other at junction 21. Member 20*a* connects to the upper part of corner support member 12 and extends diagonally downwardly to connect with the lower part of corner support member 14. Member 20*b* connects to the upper part of corner support member 14 and extends diagonally downwardly and connects to the lower part of the corner support member 12 (see FIG. 1A again). In FIG. 1B, brace assembly 22 is seen as including criss-crossing members 22*a* and 22*b* which are connected each to other at junction 23. Member 22*a* connects to the upper part of corner support member 14 and extends diagonally downwardly and connects to the lower part of corner support member 16. Member 22*b* connects to the upper part of corner support member 16 and extends diagonally downwardly for attaching to the lower section of the corner support member 14 (see FIG. 1B). Referring now to FIG. 1C, there is seen brace assembly 24 as having criss-crossing members 24*a* and 24*b* which are connected to each other at junction 25. Member 24*a* is bound to the upper part of corner support member 16 and extends diagonally downwardly and connects to the lower section of corner support member 18 as shown in FIG. 1C. Member 24*b* connects to the upper part of corner support member 18 and extends diagonally downwardly for connecting to the lower section of corner support member 16.

Figure 10A:
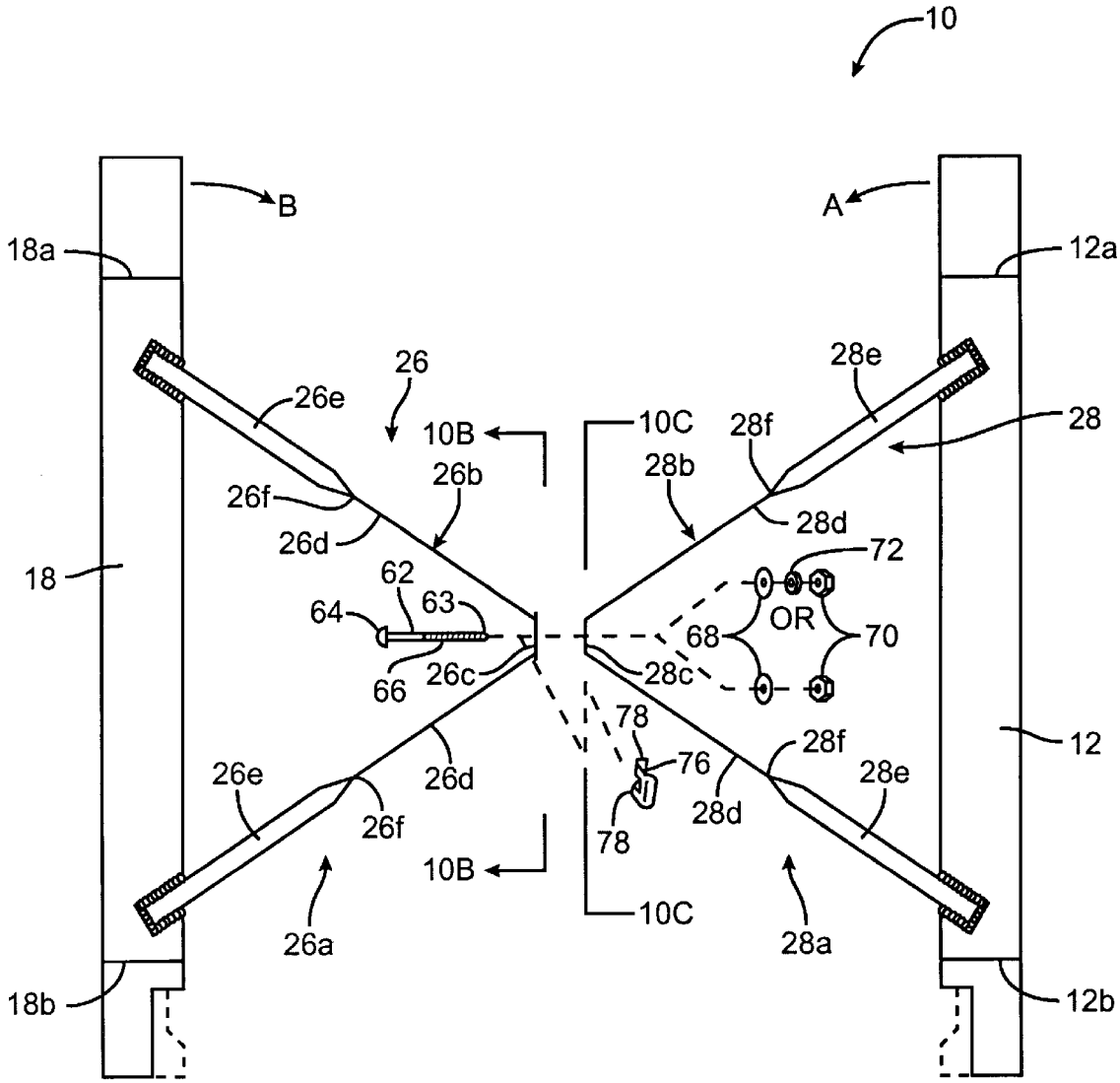
FIG. 10A is a front elevational view of the crate assembly of FIG. 9 with the nut and bolt assembly being segmented to show the various parts of the nut and bolt assembly.
Figure 10B:
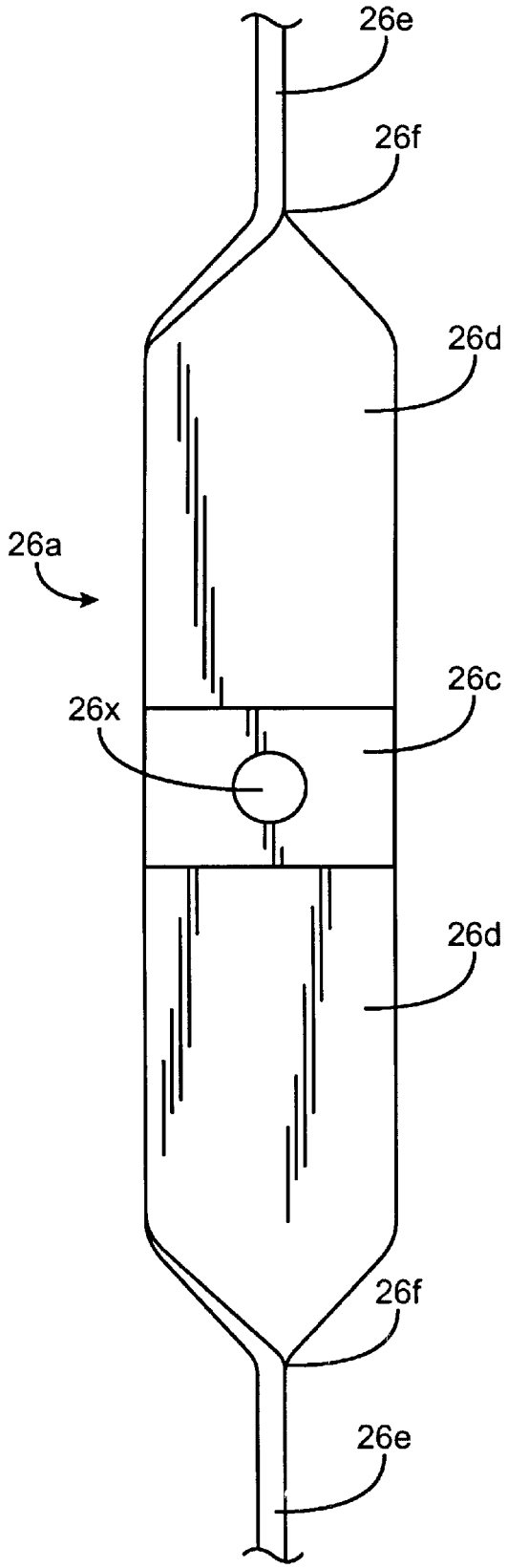
FIG. 10B is a side elevational view of one of the tension brace assemblies taken in direction of the arrows and along the plane of line 10B—10B in FIG. 10A.
Figure 10C:
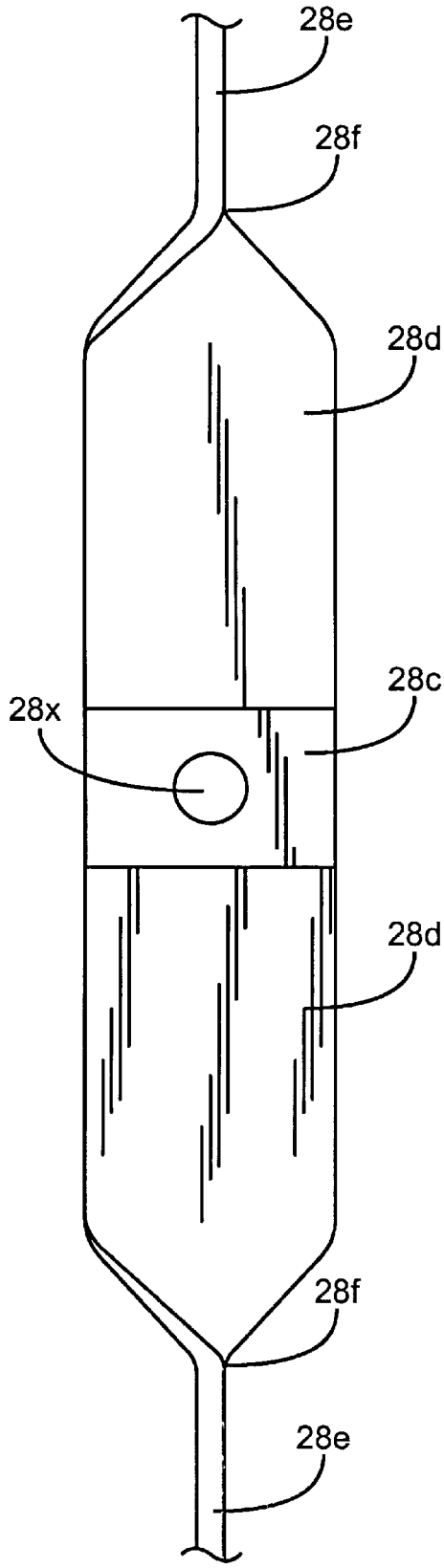
FIG. 10C is a front elevational view of the other tension brace assembly taken in direction of the arrows and along the plane of line 10C—10C in FIG. 10A.
Figure 11:
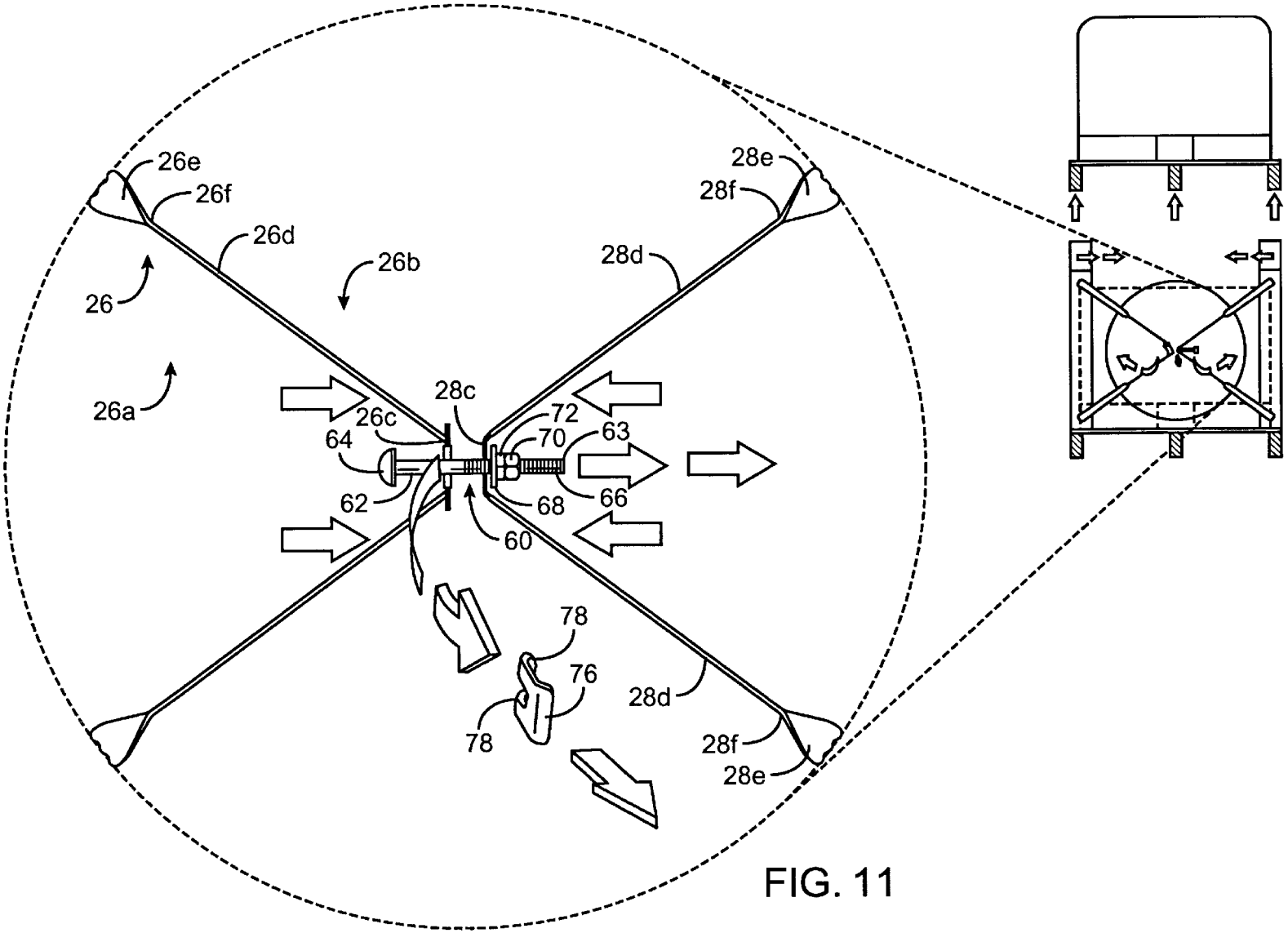
FIG. 11 is an enlarged front elevational view of the nut and bolt assembly after the locking tab has been removed from engagement with the bolt.
Figure 12A:
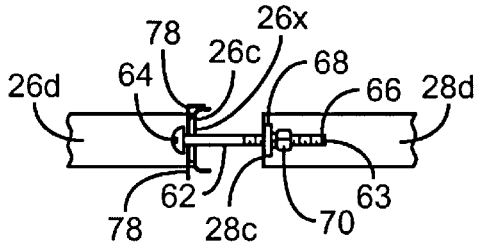
FIG. 12A is a horizontal sectional view taken in direction of the arrows and along the plane of line 12A—12A in FIG. 12.

Each of the tension brace assemblies 26 and 28 preferably has as an askewed V-shaped structure. As best shown in FIGS. 10A, 10B and 10C, tension brace assemblies 26 and 28 comprise generally V-shaped brace members 26*a* and 28*a*, respectively. V-shaped brace member 26*a* includes a generally V-shaped band member 26*b* having a base plate 26*c*, and a pair of brace arms 26*d*—26*d* integrally bound to the base plate 26*c* and terminating in a pair of brace ends 26*e*—26*e* secured to the corner support member 18 as shown in FIG. 10A. The base plate 26*c* preferably has an opening 26*x*. Between the brace ends 26*e*—26*e* and the brace arms 26*d*—26*d* are askewed or twisted junctions 26*f*—26*f* for coupling the brace arms 26*d*—26*d* to the brace ends 26*e*—26*e*, respectively. V-shaped brace member 26*a* is essentially an integral or continuous structure with the twisted junctions 26*f*—26*f* representing a ninety (90) degree bending of the structures of the brace arms 26*d*—26*d* and a continuation of the structures for forming the brace ends 26*e*—26*e*. Thus, brace ends 26*e*—26*e* are generally normal with respect to the brace arms 26*d*—26*d* and vice versa.

V-shaped brace member 28*a* includes a generally V-shaped band member 28*b* having a base plate 28*c*, and a pair of brace arms 28*d*—28*d* integrally bound to the base plate 28*c* and terminating in a pair of brace ends 28*e*—28*e* secured to the corner support member 12 as shown in FIG. 10A. The base plate 28*c* preferably has an opening 28*x*. Between the brace ends 28*e*—28*e* and the brace arms 28*d*—28*d* are askewed or twisted junctions 28*f*—28*f* for respectively coupling the brace arms 28*d*—28*d* to the brace ends 28*e*—28*e*. V-shaped brace member 28*a* is essentially an integral or continuous structure with the twisted junctions 28*f*—28*f* representing a ninety (90) degree bending of the structures of the brace arms 28*d*—28*d* and a continuation of the structures for forming the brace ends 28*e*—28*e*. Thus, brace ends 28*e*—28*e* are generally normal with respect to the brace arms 28*d*—28*d* and vice versa.

The brace assemblies 20, 22 and 24 are preferably manufactured from a material (e.g. a light weight metal) that has enough strength and elasticity such that when the upper pallet 30 (including any associated articles 32 of commerce being supported thereby) rests on the upper surfaces of the upper shelves 12*a*, 14*a*, 16*a* and 18*a* of the corner support members 12, 14, 16 and 18, respectively, the weight of upper pallet 30 and its associated articles 32 of commerce may be supported by the corner support members 12, 14, 16 and 18 in a generally upright position as shown in FIG. 1A. The connecting assembly 29 is capable of placing tension on the tension brace assemblies 26 and 28 when the upper pallet 30 is being supported by the upper shelves 12*a*, 14*a*, 16*a* and 18*a* of the corner support members 12, 14, 16 and 18, respectively. More specifically, when the connecting assembly 29 is tightened, the base plates 26*c* and 28*c* of the tension brace assemblies 26 and 28 respectively are moved towards each other, eventually placing tension on the brace arms 26*d*—26*d*, the brace ends 26*e*-26*c* and on the brace arms 28*d*—28*d*, the brace ends 28*e*—28*e* of the tension brace assemblies 26 and 28, respectively, as the upper pallet 30 is being compressed between the upper structure of the corner support members 12 and 18. The amount of tension on the tension brace assemblies 26 and 28 would be to an extent or of such magnitude that the connecting assembly 29 may not be manually operated for disengaging or discoupling tension brace assembly 26 from tension brace assembly 28 while the upper pallet 30 remains supported by the upper shelves 12*a*, 14*a*, 16*a*, and 18*a* of the corner support members 12, 14, 16 and 18, respectively, in a frictionally engaged position. Thus, tools would be required to operate the connecting assembly 29 to disengage or decouple tension brace assembly 26 from tension brace assembly 28 while the upper pallet 30 remains supported by the upper shelves 12*a*, 14*a*, 16*a*, and 18*a* of the corner support members 12, 14, 16 and 18, respectively, in a frictionally engaged position. The base plates 26*c* and 28*c* of tension brace assemblies 26 and 28, respectively, remain spaced apart after sufficient tightening of the connecting assembly 29 such that when the upper pallet 30 is removed from the upper shelves 12*a*, 14*a*, 16*a* and 18*a* of the corner support members 12, 14, 16 and 18, respectively, there is space or room for the base plates 26*c* and 28*c* to move towards each other.

The brace assemblies 20, 22 and 24 are also preferably manufactured from a material that has enough strength and elasticity such that when the upper pallet 30 (and its associated articles 32 of commerce) are removed from the upper shelves 12*a*, 14*a*, 16*a* and 18*a* of the corner support members 12, 14, 16 and 18, the release of this upper pallet 30 causes the corner support members 12, 14, 16 and 18 to all move such that corner support members 12 and 18, respectively, move in direction of arrows A and B in FIG. 2, causing a release of all tension on the tension brace assemblies 26 and 28 and on the connection assembly 29 such that connecting assembly 29 may be manually operated (i.e. no tools are required) to disengage or decouple tension brace assembly 26 from tension brace assembly 28. In a preferred embodiment of the present invention, the respective members of the brace assemblies 20, 22 and 24 are manufactured of 12 gauge sheet metal (carbon Steel). Also in a preferred embodiment of the present invention, the corner support members 12, 14, 16 and 18 are manufactured of 12 gauge sheet metal (carbon steel), and the shelves (i.e. upper shelves 12*a*, 14*a*, 16*a* and 18*a*, and lower shelves 12*b*, 14*b*, 16*b* and 18*b*) are also made of 12 gauge sheet metal (carbon steel).

Figure 7:
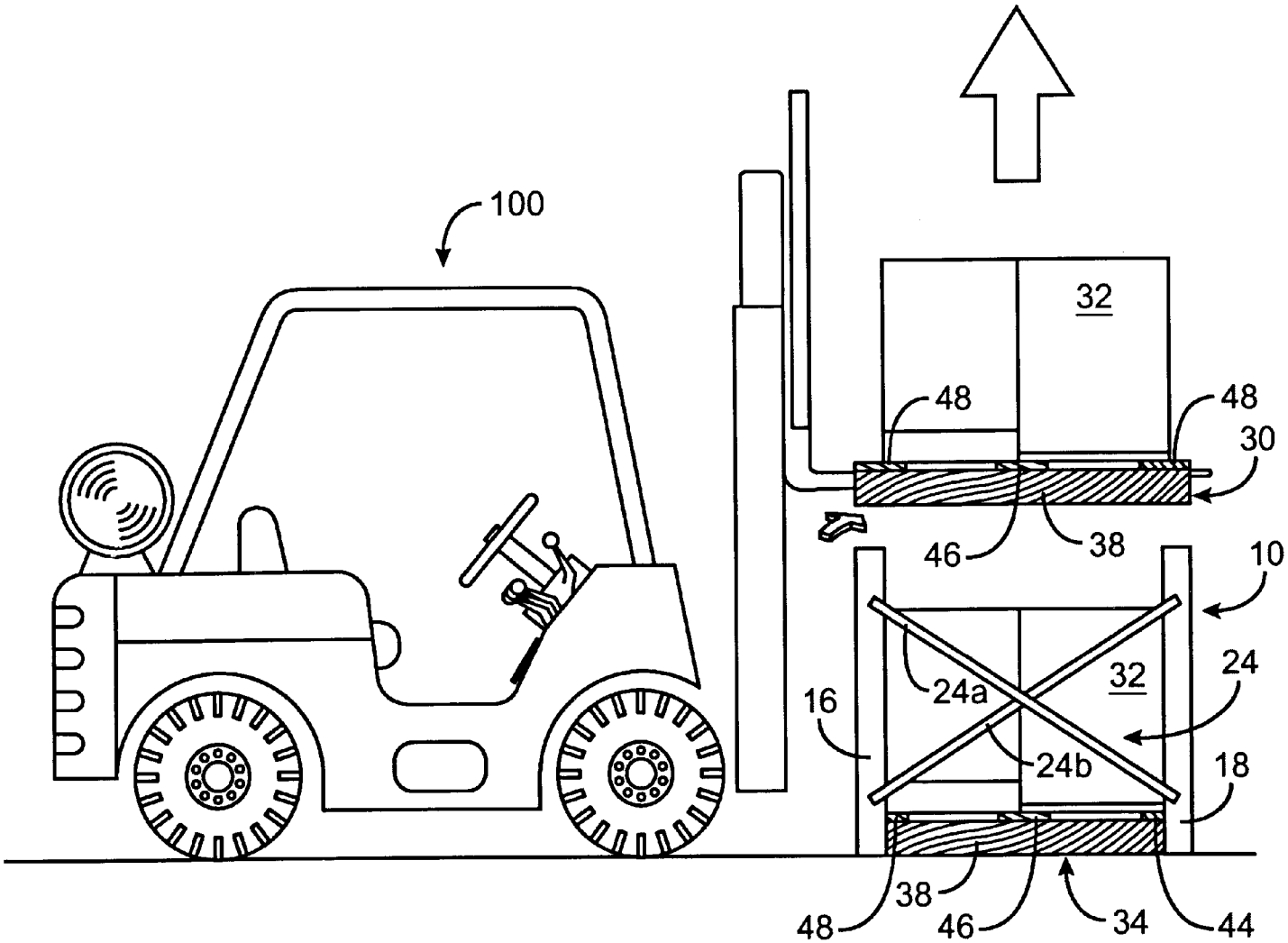
FIG. 7 is the side elevational view of the fork lift of FIG. 6 after the fork lift members of the fork lift vehicle have elevated the upper pallet (including articles of commerce being carried by the upper pallet) off of the upper shelves of the corner support members of the crate assembly.

The connecting assembly 29 for the present invention may be any suitable interconnecting assembly that is capable of moving the support corner members 12 and 18 towards each other in direction of the arrows A and B, respectively, for compressing and/or "sandwiching" the upper pallet 30 there between and for placing tension on the tension brace assemblies 26 and 28. Thus, a frictional fit is being produced between the top section of the corner support members 12 and 18 and the upper pallet 30. The connecting assembly 29 is mechanically tightened (e.g. with a wrench, pliers, a screwdriver, etc.) to place the required tension on the tension brace assemblies 26 and 28 in respectively moving the corner support members 12 and 18 in direction of the arrows A and B (see FIG. 2) and towards each other for frictionally, biasingly engaging the upper pallet 30 with the tops of the corner support members 12 and 18 while the upper pallet 30 is being supported by the upper shelves 12*a*, 14*a*, 16*a* and 18*a* of the corner support members 12, 14, 16 and 18, respectively. While the connecting assembly 29 is being mechanically tightened to bias the corner support members 12 and 18 towards each other and place tension on the tension brace assemblies 26 and 28, the base plates 26*c* and 28*c* of the respective tension brace assemblies 26 and 28 remain spaced apart such that when the top pallet 30 (including its associated articles 32 of commerce) is removed by the fork lift vehicle 100 (see FIGS. 7 and 8), the corner support members 12 and 18, respectively, move in direction of the arrows A and B and towards each other, causing the two base plates 26*c* and 28*c* of the tension brace assemblies 26 and 28 to also move towards each other (e.g. in direction of the arrows C and D in FIGS. 8 and 9) such that the connecting assembly 29 becomes a loose fit (or a tensionless engagement) with the two base plates 26*c* and 28*c* and manually operation (i.e. without employment of tools) of the connecting assembly 29 is feasible for decoupling or disengaging the tension brace assemblies 26 and 28 from each other (e.g. see FIGS. 12–15). After the connecting assembly 29 is free from engagement with the base plate 26*c* and/or base plate 28*c* of the tension brace assemblies 26 and 28, respectively, the tension brace assemblies 26 and 28 may be bent and/or pulled forward and away from the corner support members 18 and 12, respectively, (see FIG. 19). After this, the crate assembly 10 may be pivoted off of the lower pallet 34 (e.g. in direction of arrows M and N in FIG. 20) and either reused or discarded into a scrap bin 200, as best shown in FIG. 21. In the removal of the crate assembly 10 from or off of the lower pallet 34, it is pivoted or moved (preferably manually pivoted or moved) about ninety (90) degrees; that is, from the upright or vertical posture of FIG. 19 into the transverse or horizontal posture of FIG. 20.

Figure 8:
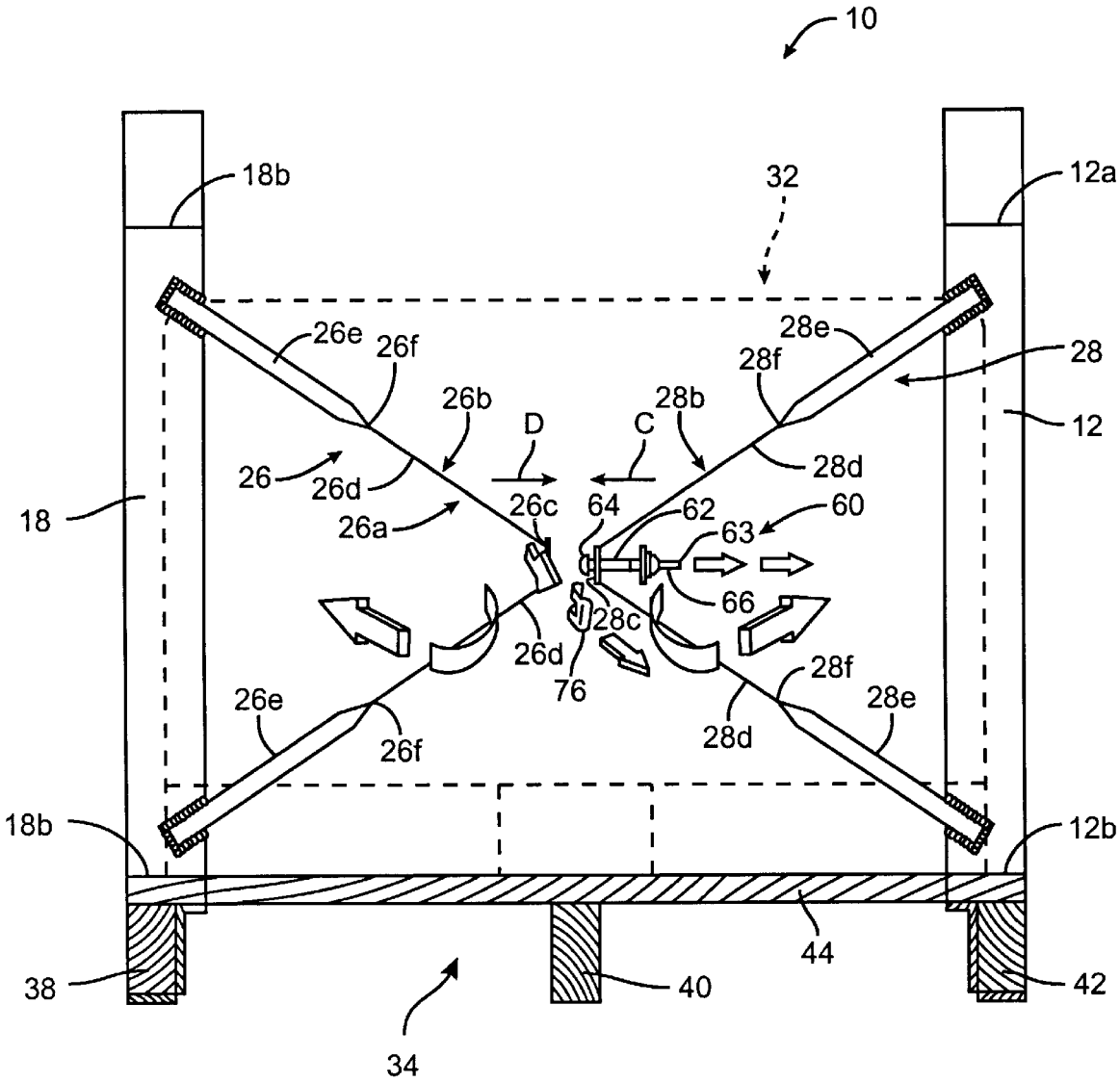
FIG. 8 is a side elevational view of the front of the crate assembly of FIG. 7 after the upper pallet has been removed off of the upper shelves of the corner support members of the crate assembly, allowing the front pair of corner support members to move towards each other for releasing tension on the tension brace assemblies such that the nut and bolt assembly, which interconnects the tension brace assemblies together, may be manually removed from engaging one of the tension brace assemblies.
Figure 9:
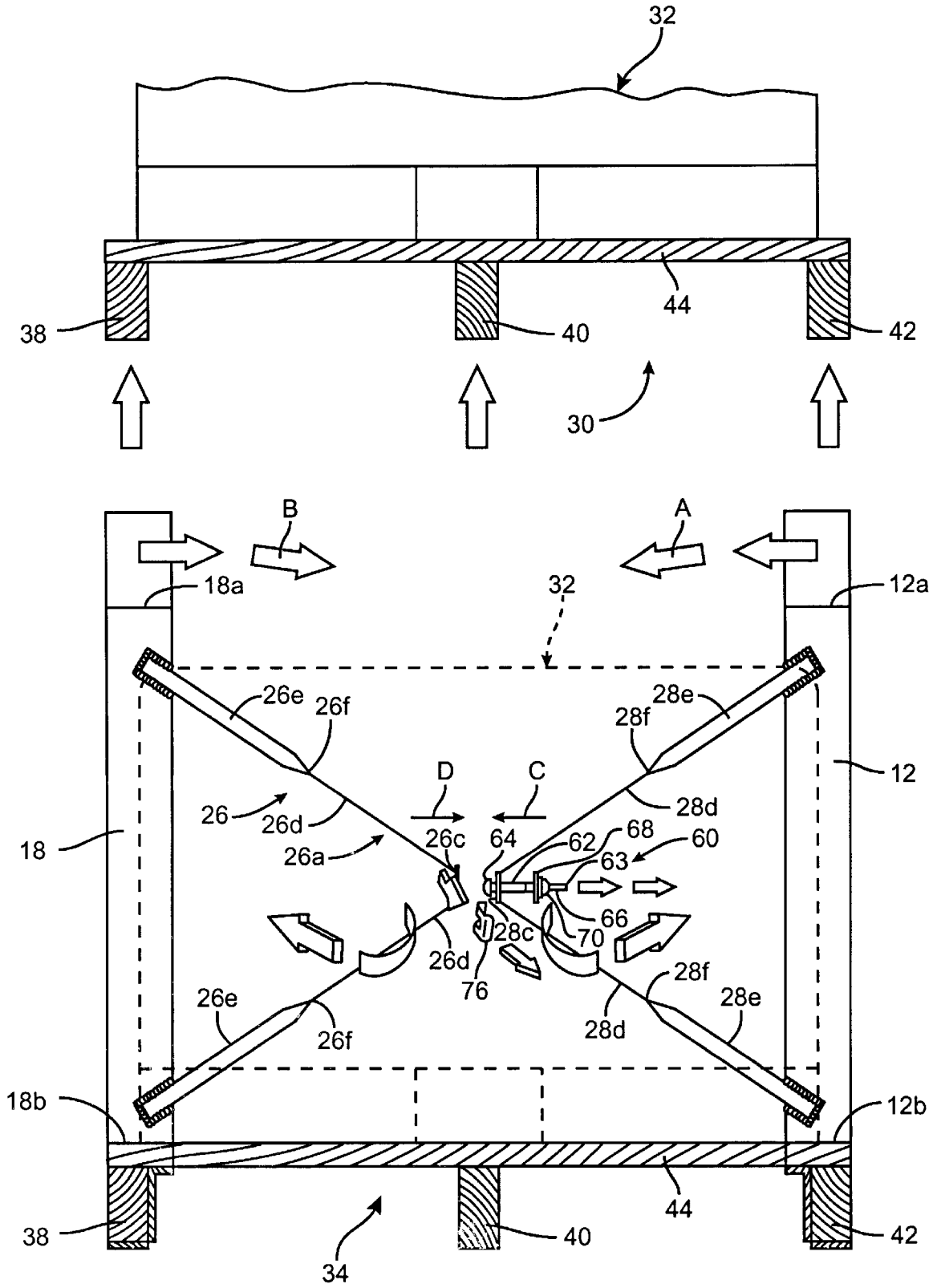
FIG. 9 is another side elevational view of the front of the crate assembly of FIG. 8 showing the direction of movement of the upper pallet when moved by the fork lift members of the fork lift vehicle, with arrows illustrating the direction of movements of the two front corner support members towards each other to release tension on the tension brace assemblies such that the nut and bolt assembly may be manually removed from engagement from one of the tension brace assemblies.

The connecting assembly 29 preferably comprises a nut and bolt assembly, generally illustrated as 60 (see FIGS. 2, 8, 9, 10A, 11 and FIGS. 12–15A and 16). The nut and bolt assembly 60 includes a bolt 62 having a head 64 and a threaded end 63 which is threaded with threads 66. A washer 68 and nut 70, and optionally a lock washer 72, is provided. As best shown in FIGS. 8 and 9, the washer 68 and lock washer 72 are slid over the threads 66 of the bolt 62, and are retained there by the nut 70 when the nut 70 is threadably engaged to the threads 66 of the threaded end 63 of the bolt 62. The nut and bolt assembly 69 also includes a locking tab 76 which comprises a pair of parallel spaced arms 78—78 (see FIGS. 10A and 16).

Figure 12:
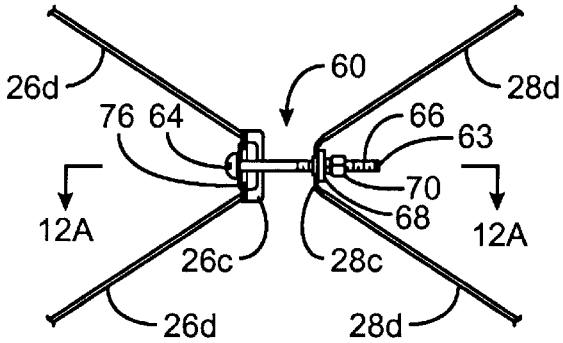
FIG. 12 is a partial side elevational view of the two tension brace assemblies coupled tensionly together by the nut and bolt assembly when the upper pallet is being supported by the crate assembly.

The space between the arms 78—78 of the locking tab 76 is slightly larger than the diameter of the bolt 62, but less than the diameter of the head 64 of the bolt 62. The head 64 of the bolt 62 has a diameter that is less than the diameter of the opening 26*x* of the base plate 26*c* of tension brace assembly 26 (more specifically, of V-shaped brace member 26*a*). After bolt 62 is passed in the space between the arms 78—78 of the locking tab 76 to commence coupling together of the two tension brace assemblies 26 and 28, the bottom of the head 64 of the bolt 62 is flushed against the surfaces of the arms 78—78 (as shown in FIGS. 2 and 12). The threaded end 63 of the bolt 62 is then passed through the opening 26*x* of the base plate 26*c* of V-shaped brace member 26*a* and subsequently through the opening 28*x* of the base plate 28*c* of V-shaped brace member 28*a*. Arms 78—78 of the locking tab 76 prevent the head 64 of the bolt 62 from passing through the opening 26*x* of the base plate 26*c* of V-shaped brace member 26*a*. The threaded end 63 of the bolt 62 is subsequently passed through the washer 68 and the lock washer 72 (in order stated) and is then threadably connected to the nut 70.

The outside diameter of the washer 68 is larger than the diameter of the opening 28*x* of the base plate 28*c* of V-shaped brace member 28*a* such that the nut 70 may be tightened to flush the washer 68 against the base plate 28*c*. After the upper pallet 30 has been disposed on the upper shelves 12*a*, 14*a*, 16*a* and 18*a* of the corner support members 12, 14, 16 and 18, respectively, a tool (e.g. a wrench or pliers) is used to rotate the nut 70 clockwise to commence moving the nut 70 towards the head 64 of the bolt 62 to move base plates 26*c* and 28*c* towards each other and to commence moving the corner support members 12 and 18 in direction of the arrows A and B, respectively, and placing tension on the tension brace assemblies 26 and 28.

Nut 70 is continually tightened with a tool for compressing and/or "sandwiching" the upper pallet 30 between the top parts of the corner support members 12 and 18 until the desired frictional engagement has been obtained between the top parts of the corner support members 12 and 18 and the upper pallet 30. The upper pallet 30 has a width and the tension brace assemblies 26 and 28 have a length or dimension such that after sufficient tightening of the nut 70, the base plates 26*c* and 28*c* of the tension brace assemblies 26 and 28, respectively, remain spaced apart such that they are free to move toward each other after the upper pallet 30 is removed from being supported by the crate assembly 10.

The crate assembly 10 is now supported by the lower pallet 34 and has been frictionally engaged to the upper pallet 30. The two pallets 30 and 34 (and their associated articles 32 of commerce) may now be conveniently transported together, such as on a flat bed truck, while remaining superimposedly situated with respect to each other by the crate assembly 10.

Figure 13A:
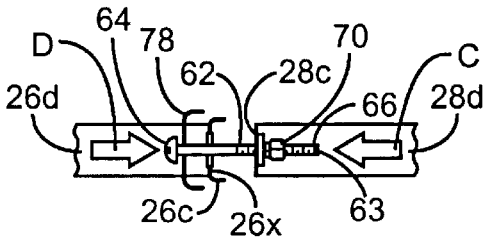
FIG. 13A is a horizontal sectional view taken in direction of the arrows and along the plane of line 13A—13A in FIG. 13.
Figure 13:
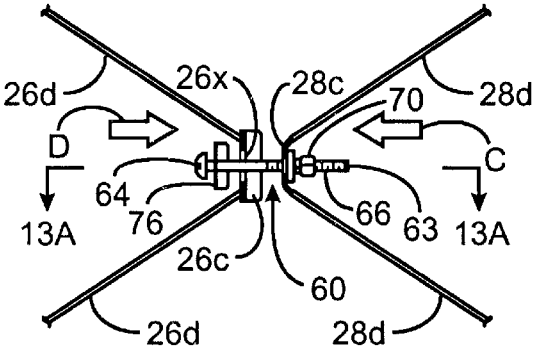
FIG. 13 is a partial side elevational view of the two tension brace assemblies after the upper pallet has been removed from being supported by the crate assembly and after the two front corner support members have moved inwardly and towards each other, causing tension on the two tension brace assemblies to be released by the tension brace assemblies moving towards each other and further causing the nut and bolt assembly to loosely, tensionlessly engage the two tension brace assemblies.

When arriving at a desired destination, the fork lift vehicle 100 (see FIGS. 4–8) removes the upper pallet 30 off of the upper shelves 12*a*, 14*a*, 16*a*, 18*a* of the corner support members 12, 14, 16 and 18, causing the corner support members 12 and 18 to move in direction of the arrows A and B, respectively, and towards each other. As the corner support members 12 and 18 move towards each other, the base plates 26*c* and 28*c* of the tension brace assemblies 26 and 28 move in direction of the arrows C and D (see FIGS. 8 and 9) and towards each other such that the nut and bolt assembly 60 makes a loose and tensionless connection with the two base plates 26*c* and 28*c*, as shown in FIGS. 13 and 13A.

Figure 14A:
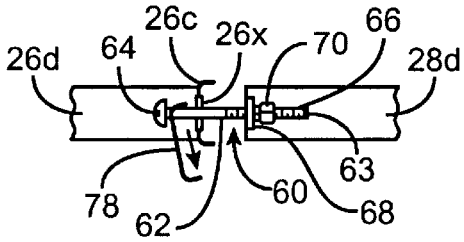
FIG. 14A is a horizontal sectional view taken in direction of the arrows and along the plane of line 14A—14A in FIG. 14.
Figure 14:
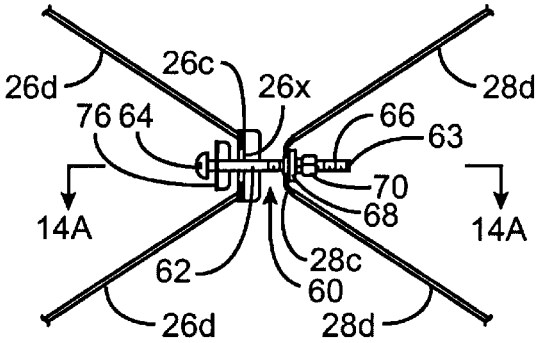
FIG. 14 is a partial side elevational view of the two tension brace assemblies of FIG. 13 with the locking tab being removed from engagement with the bolt.
Figure 15A:
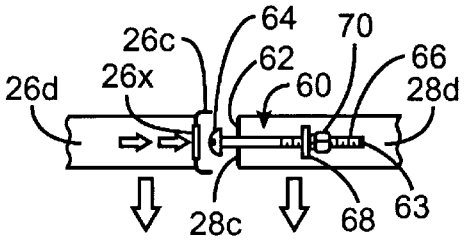
FIG. 15A is a horizontal sectional view taken in direction of the arrows and along the plane of line 15A—15A in FIG. 15.
Figure 15:
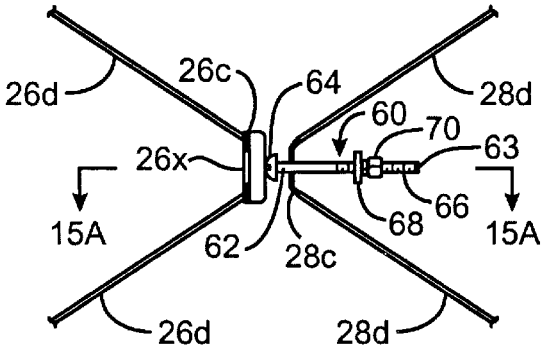
FIG. 15 is a partial side elevational view of the two tension brace assemblies of FIG. 14 after the locking tab has been moved from engagement with the bolt and after the head of the bolt has passed through an opening in the base plate of one of the tension brace assemblies, all for the decoupling the tension brace assemblies from each other to uncrate the container assembly.
Figure 16:
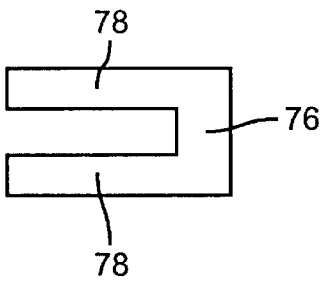
FIG. 16 is a top plan view of the locking tab which is for engaging the bolt and for preventing the head of the bolt from passing through an opening in the base plate of one of the tension brace assemblies.
Figure 18:
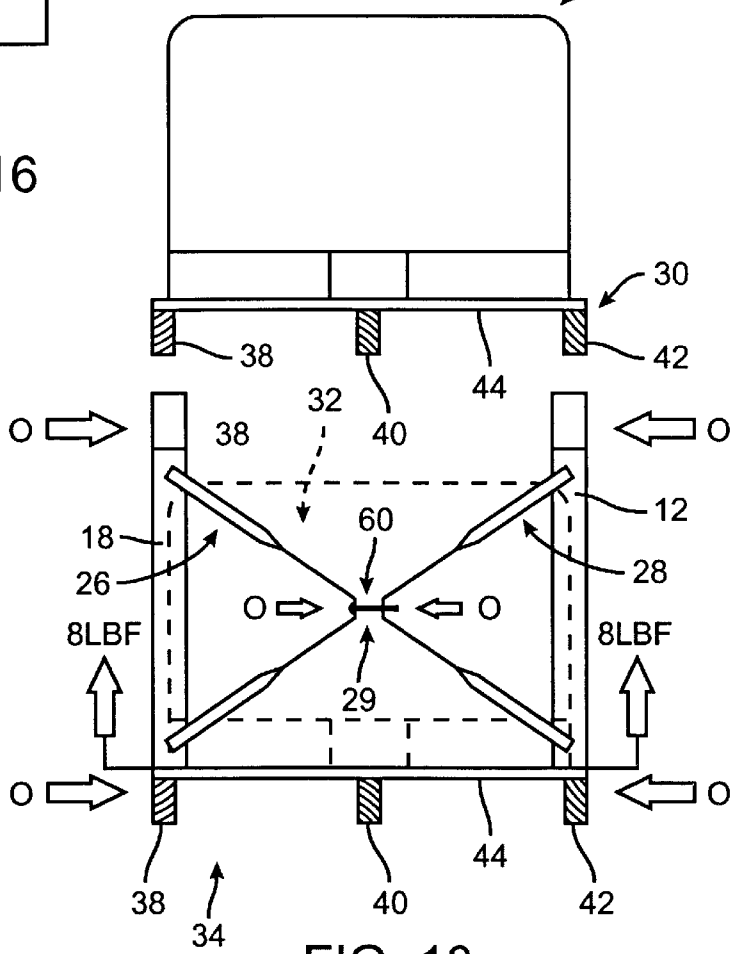
FIG. 18 is a front elevational view of the crate assembly of FIG. 17 after the upper pallet has been removed from being frictionally supported by the crate assembly, with various vectors being shown for representing forces on the crate assembly after the upper pallet has been removed.
Figure 17:
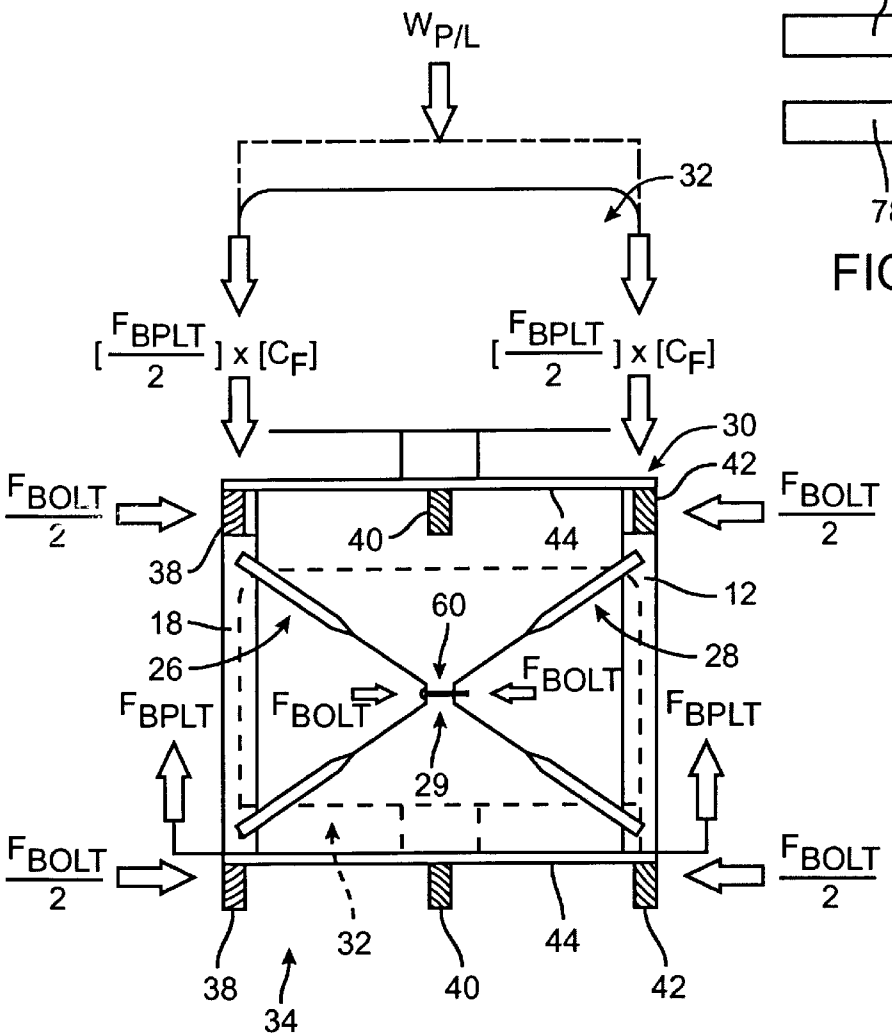
FIG. 17 is a front elevational view of the crate assembly being supported by the lower pallet and supporting the upper pallet, with various vectors being shown representing the various forces on the crate assembly when the upper pallet is being supported by the crate assembly.
Figure 19:
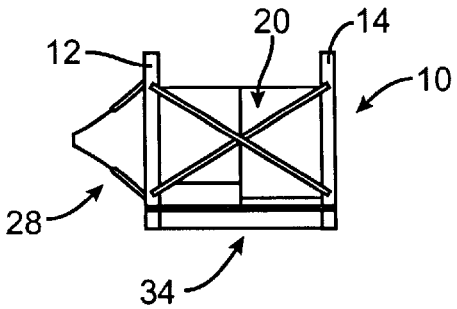
FIG. 19 is a side elevational view of the crate assembly being supported by the lower pallet after the pair of tension brace assemblies have been bent outwardly and away from the two front corner support members.

The locking tab 76 is slidably removed from the bolt 62 such that the bolt 62 does not occupy the space between the arms 78—78 of the locking tab 76 as shown in FIGS. 14 and 14*a*. The head 64 of the bolt 62 may now be passed through the opening 26*x* of the base plate 26*c* of the V-shaped brace member 26*a*, as best shown in FIGS. 15 and 15A; thus decoupling tension brace assembly 26 from tension brace assembly 28. After the bolt 62 is free from engagement with the box plate 26*c* of tension brace assembly 26, the two tension brace assemblies 26 and 28 may be bent and/or pulled forward and away from the corner support members 18 and 12, respectively, as best shown in FIG. 19.

Figure 20:
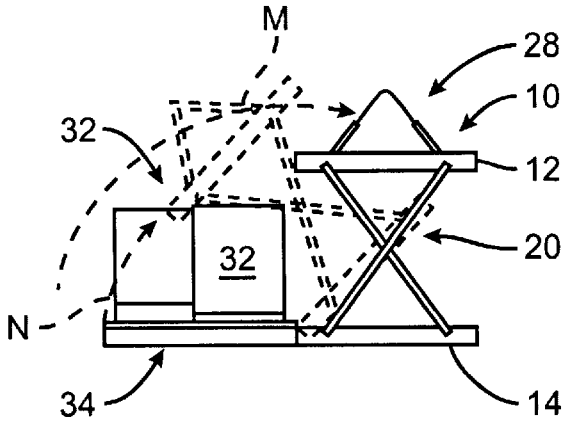
FIG. 20 is the side elevational view of the crate assembly of FIG. 19 after the crate assembly has been pivoted approximately 90°, from an upright or vertical position into a transverse or horizontal position.
Figure 21:
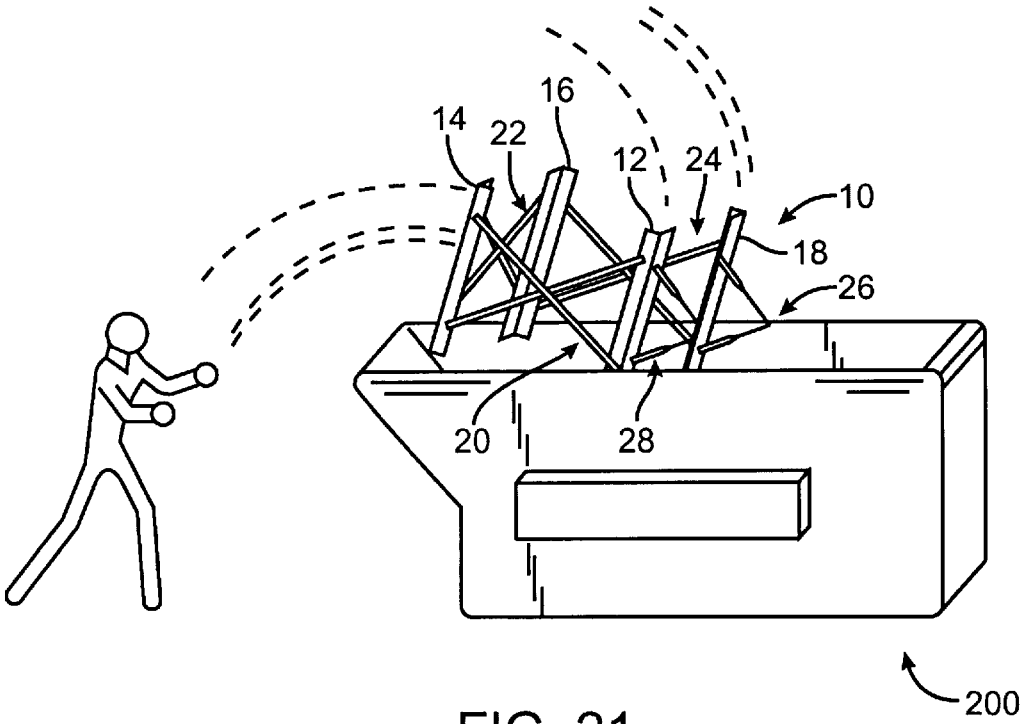
FIG. 21 is a perspective view of the crate assembly being discarded into a scrap bin.

The crate assembly 10 may now be removed off of the lower pallet 34 by pivoting the crate assembly 10 in direction of the arrows N and U in FIG. 20. Stated alternatively, the crate assembly 10 may now be pivoted about 90° from the upright or vertical position shown in FIG. 19 into the transverse or horizontal position of FIG. 20 for discard into scrap bin 200 or for reuse.

Figure 24:
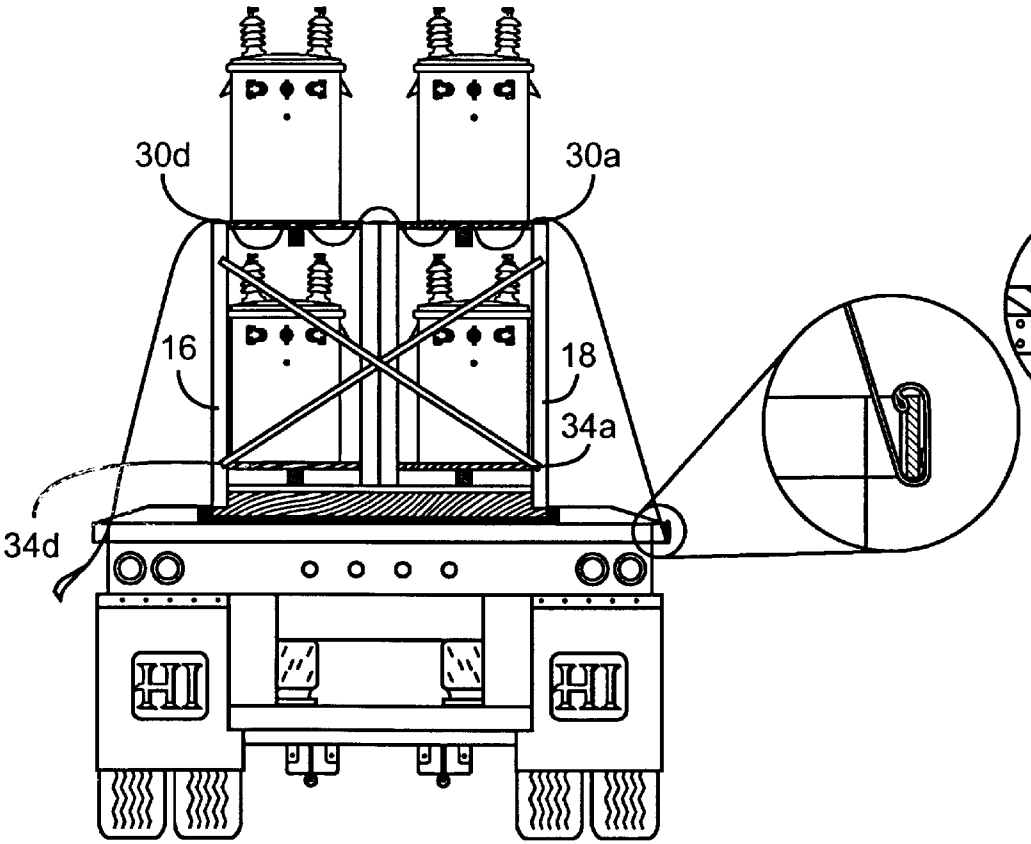
FIG. 24 is an end elevational view of the container assembly and the flat bed trailer of FIG. 23.
Figure 25:
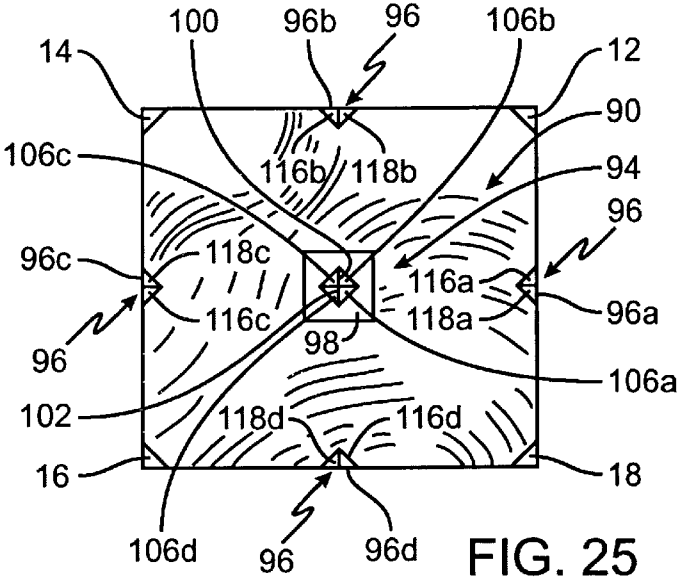
FIG. 25 is a top plan view of the crate assembly having a base, four (4) corner support members connected to the base, a centric support member connected to the base, and four (4) intermediate support members connected to the base such that an intermediate support members is between any two (2) corner support members.
Figure 30:
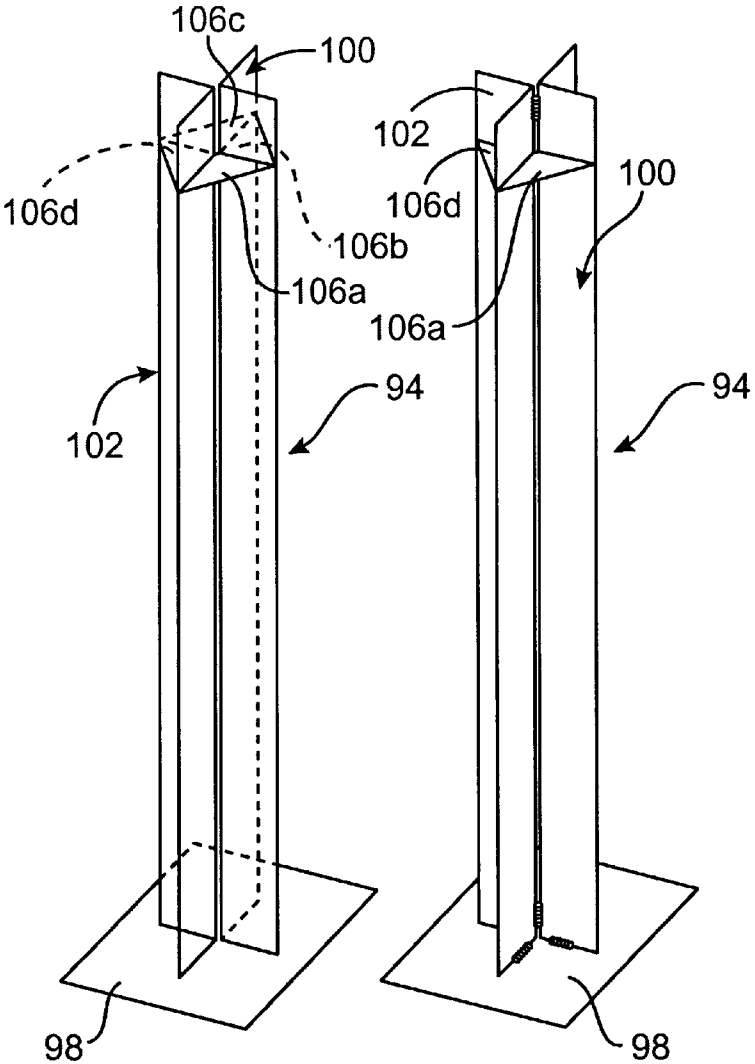
FIG. 30 is a perspective view of the center or centric support member.

Referring in detail now to FIGS. 22–34 for another embodiment of the present invention, there is seen another embodiment of the crate assembly 10, which is capable of receiving and transporting more than two (2) pallets, preferably four (4) pallets (see FIGS. 33 and 34) or eight (8) pallets (see FIGS. 22–32). For the embodiment of the crate assembly 10 that is capable of transporting eight (8) pallets, the crate assembly 10 includes a base 90, the corner support members 12, 14, 16 and 18, connected to the base 90, and which respectively, include upper shelves 12*a*, 14*a*, 16*a* and 18*a* and lower shelves 12*b*, 14*b*, 16*b* and 18*b* (see FIGS. 1D, 1E and 31). This embodiment of the crate assembly 10 also includes a center or centric support member, generally illustrated as 94 (see FIGS. 25 and 30), connected to base 90, and side or intermediate support members, each generally illustrated as 96 (see FIG. 32), also connected to base 90. The center support member 94 includes a base 98 for securing to base 90, a pair of angle iron members 100 and 102 secured together and connected to base 98 such as to represent a cross with respect to a top plan view (see FIG. 25). The center support member 94 also includes shelves 106*a*, 106*b*, 106*c* and 106*d* (see FIGS. 25 and 30). Shelves 106*a* and 106*c* are connected to (and assist in interconnecting) angle iron members 100 and 102 as best shown in FIG. 30. Shelves 106*b* and 106*d* are connected to angle iron members 100 and 102, respectively. In a preferred embodiment of the invention, the crate assembly 10 comprises four intermediate support members 96*a*, 96*b*, 96*c* and 96*d*, all connected to the base 90 as best shown in FIG. 25. Intermediate support members 96*a*, 96*b*, 96*c* and 96*d*, respectively, include back members 110*a*, 110*b*, 110*c* and 10*d*, having respectively secured thereto partitions 112*a*, 112*b*, 112*c* and 112*d*. Intermediate support members 96*a* and 96*b*, respectively, have upper shelves 116*a* and 118*a*, 116*b* and 118*b*, and lower shelves 120*a* and 122*a*, 120*b* and 122*b*, all connected to back 110a-partition 112*a* and back 110*b*-partition 112*b*, respectively. Similarly, intermediate support members 96*c* and 96*b*, respectively, have upper shelves 116*c* and 118*c*, 116*d* and 118*d*, and lower shelves 120*c* and 122*c*, 120*d* and 122*d*, all connected to back 110*c*-partition 112*c* and back 110*d*-partition 112*d*, respectively.

The embodiment of the invention illustrated in FIGS. 22–32 employs eight (8) pallets, upper pallets 30*a*, 30*b*, 30*c* and 30*d*, and lower pallets 34*a*, 34*b*, 34*c*, and 34*d*. The upper pallets 30*a*, 30*b*, 30*c* and 30*d* may be arranged in any suitable manner on the upper shelves (e.g., shelves 116*a*–116*d* and 118*a*–118*d* of the intermediate support members 96*a*–96*d*, shelves 106*a*–106*d* of the center support 94, and upper shelves 12*a*, 14*a*, 16*a* and 18*a* of corner support members 12, 14, 16 and 18). The lower pallets 34*a*, 34*b*, 34*c* and 34*d* may be arranged in any suitable manner on the base 90 and on the lower shelves (e.g., shelves 120*a*–120*d* and 122*a*–122*d* of the intermediate support members 96*a*–96*d*, and the lower shelves 12*b*, 14*b*, 16*b* and

Figure 26:
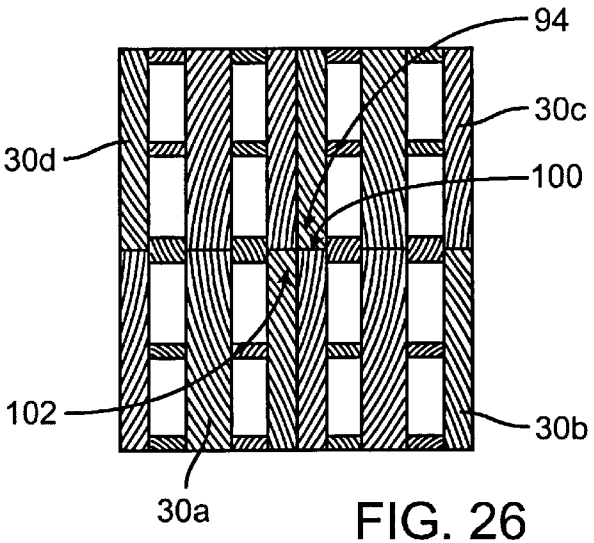
FIG. 26 is a top plan view of four (4) pallets which may be supported by the base, or by the upper shelves of the four corner support members, the upper shelves of the four intermediate members, and the shelves of the centric or center support member.
Figure 28A:
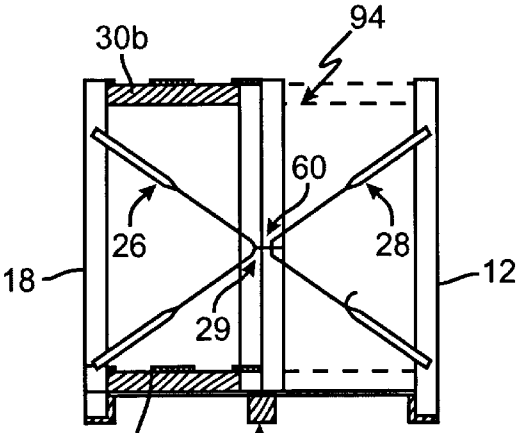
FIG. 28A is a side view of the container assembly of FIG. 27 illustrating the first connecting and tension assembly (e.g. a first pair of V-shaped brace members plus a first nut and bolt assembly)

18*b* of corner support members 12, 14, 16 and 18). By way of example only, lower pallet 34*a* may be supported by base 90, and lower shelves 120*d* and 122*a* of intermediate support members 96*d* and 96*a*, respectively, and by lower shelf 18*b* of corner support member 18. Lower pallet 34*b* may be supported by base 90, and lower shelves 120*a* and 122*b* of intermediate support members 96*a* and 96*b*, respectively, and by lower shelf 12*b* of corner support member 12. Lower pallet 34*c* may be supported by base 90, and lower shelves 120*b* and 122*c* of intermediate support members 96*b* and 96*c*, respectively, and by lower shelf 14*b* of corner support member 14. Lower pallet 34*d* may be supported by base 90, and lower shelves 120*c* and 122*d* of intermediate support members 96*c* and 96*d*, and by lower shelf 16*b* of corner support member 16. Inner corners of lower pallets 34*a*, 34*b*, 34*c* and 34*d* also lodge on base 98 and are separated by angle iron members 100 and 102 of the center support member 94, as the inner corners of upper pallets 30*a*, 30*b*, 30*c* and 30*d* are separated by angle iron members 100 and 102 as best shown in FIG. 26. By further way of example only, upper pallet 30*a* may be supported by shelf 106*a* of center support 94, by shelf 116*d* and shelf 118*a* of intermediate support members 96*d* and 96*a*, and by shelf 18*a* of corner support member 18. Upper pallet 30*b* may be supported by shelf 106*b* of center support 94, by shelf 116*a* and shelf 118*b* of intermediate support members 96*a* and 96*b*, and by shelf 12*a* of corner support member 12. Upper pallet 30*c* may be supported by shelf 106*c* of center support 94, by shelf 116*b* and shelf 118*c* of intermediate support members 96*b* and 96*c*, and by shelf 14*a* of corner support member 14. Upper pallet 30*d* may be supported by shelf 106*d* of center support 94, by shelf 116*c* and shelf 118*d* of intermediate support members 96*c* and 96*d*, and by shelf 16*a* of corner support member 16.

Figure 22A:
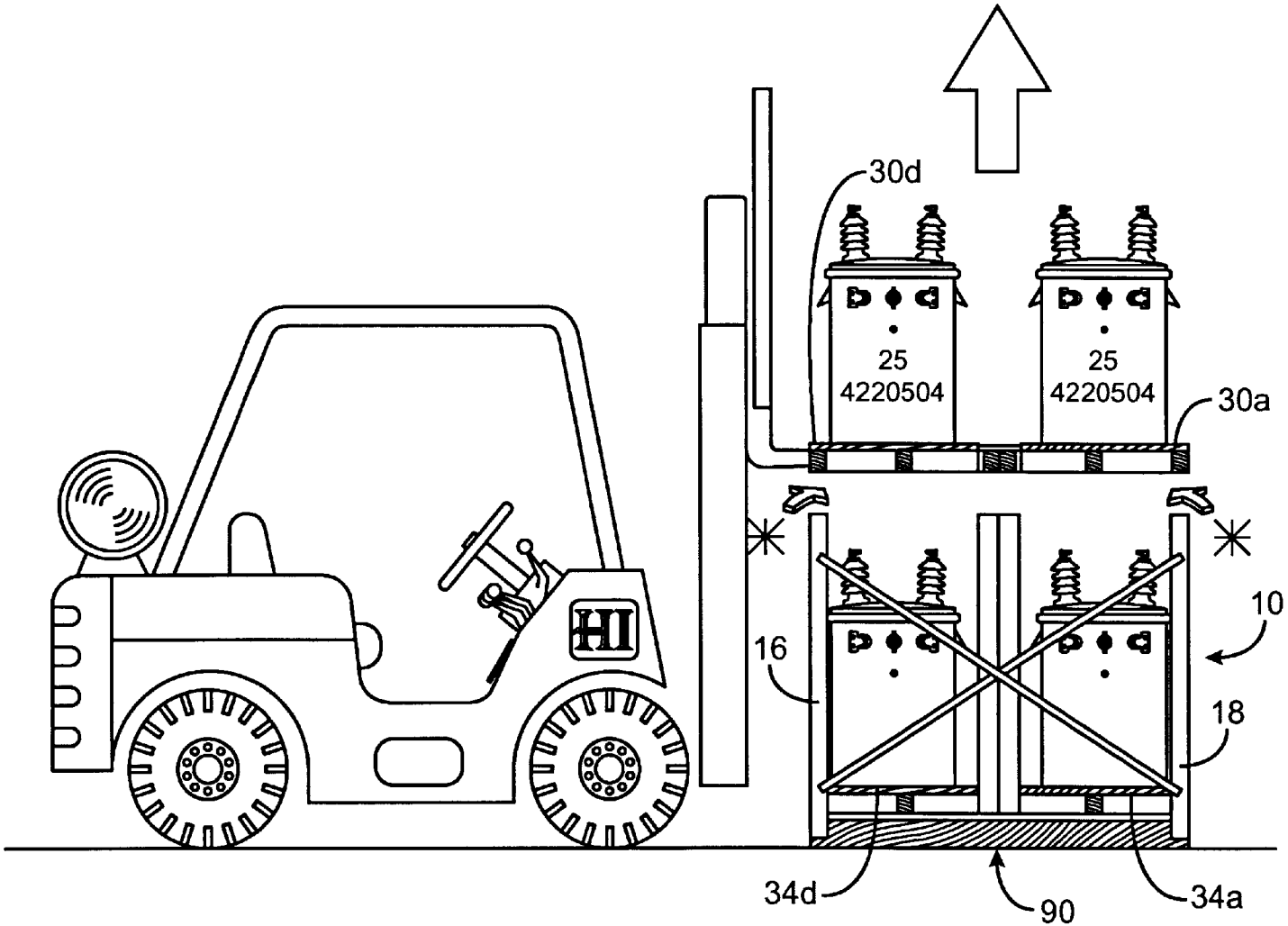
FIG. 22A is a side elevational view of a fork lift vehicle after the fork lift members of the fork lift vehicle have elevated a pair of upper pallets (including articles of commerce being carried by the upper pallets) off of the upper shelves of a pair of support members, off of shelves of a centric support member, and off of the upper shelves of intermediate support members.
Figure 22B:
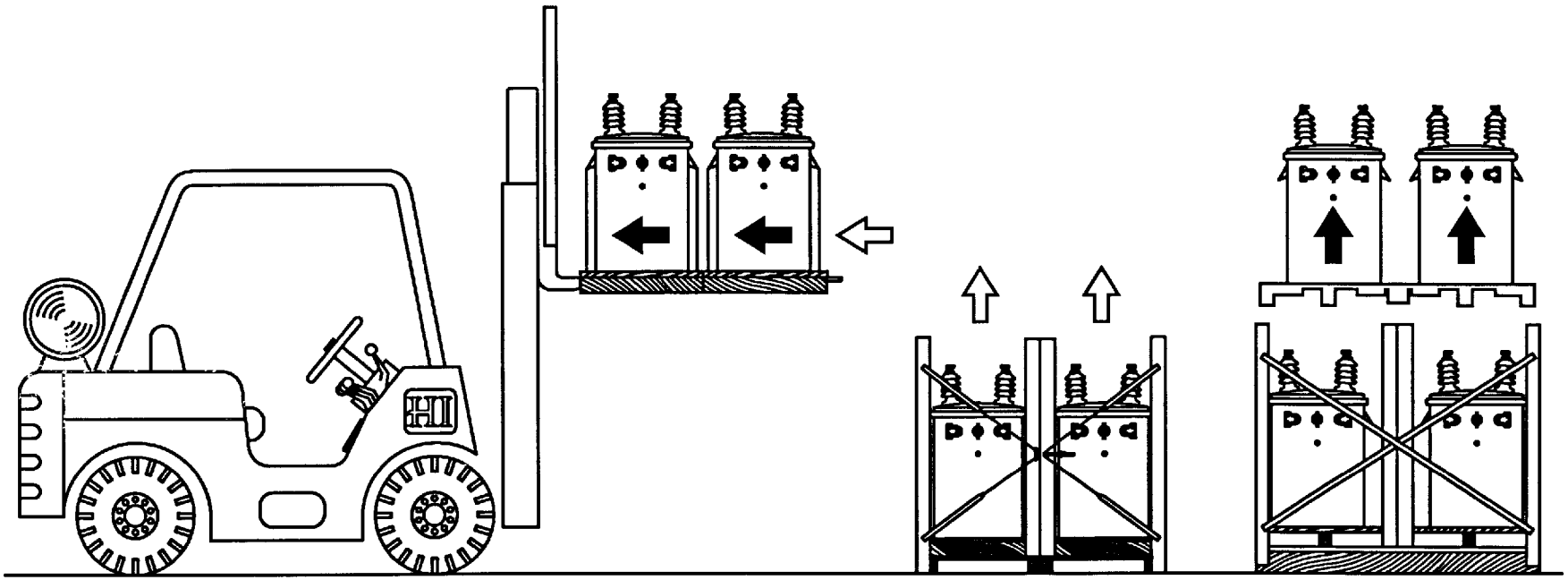
FIG. 22B is another side elevational view of a fork lift vehicle after the fork lift members of the fork lift vehicle have elevated a pair of upper pallets (including articles of commerce being carried by the upper pallets) off of the upper shelves of a pair of support members, off of shelves of a centric support member, and off of the upper shelves of intermediate support members.
Figure 23:
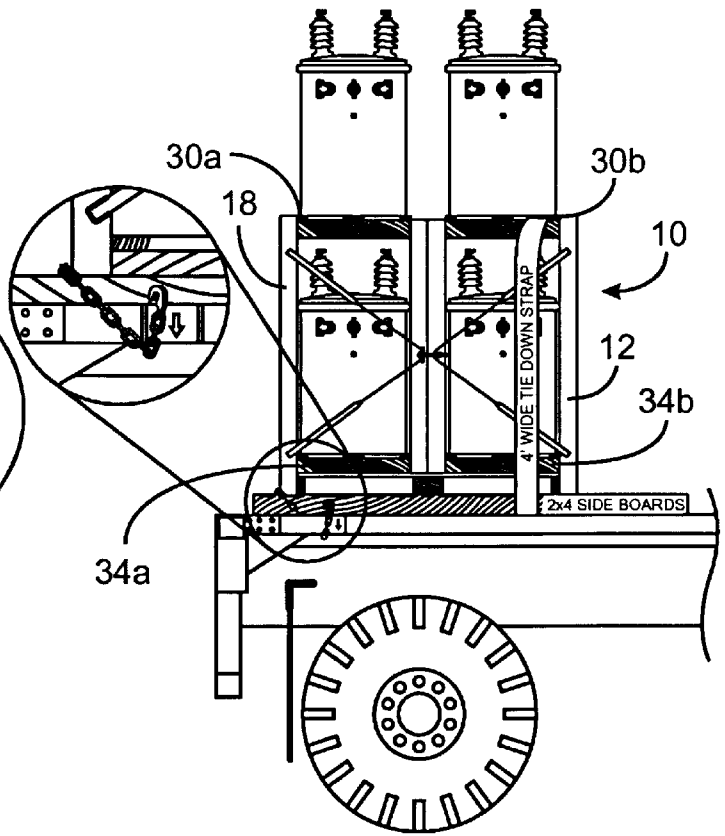
FIG. 23 is a side elevational view the container assembly having eight (8) transformers and disposed on a flat bed trailer.
Figure 27:
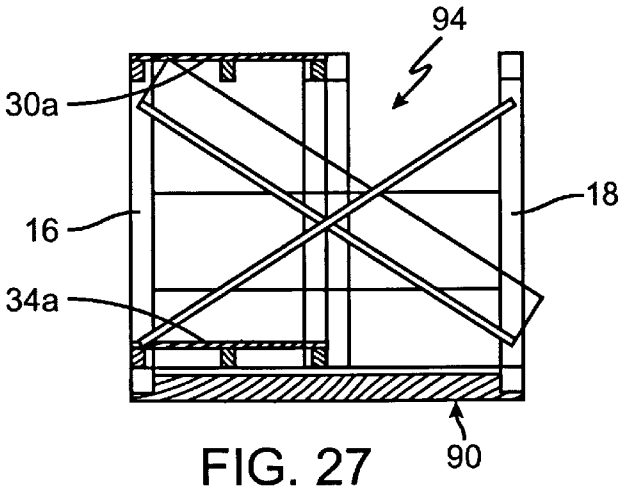
FIG. 27 is an end view of the container assembly.
Figure 28B:
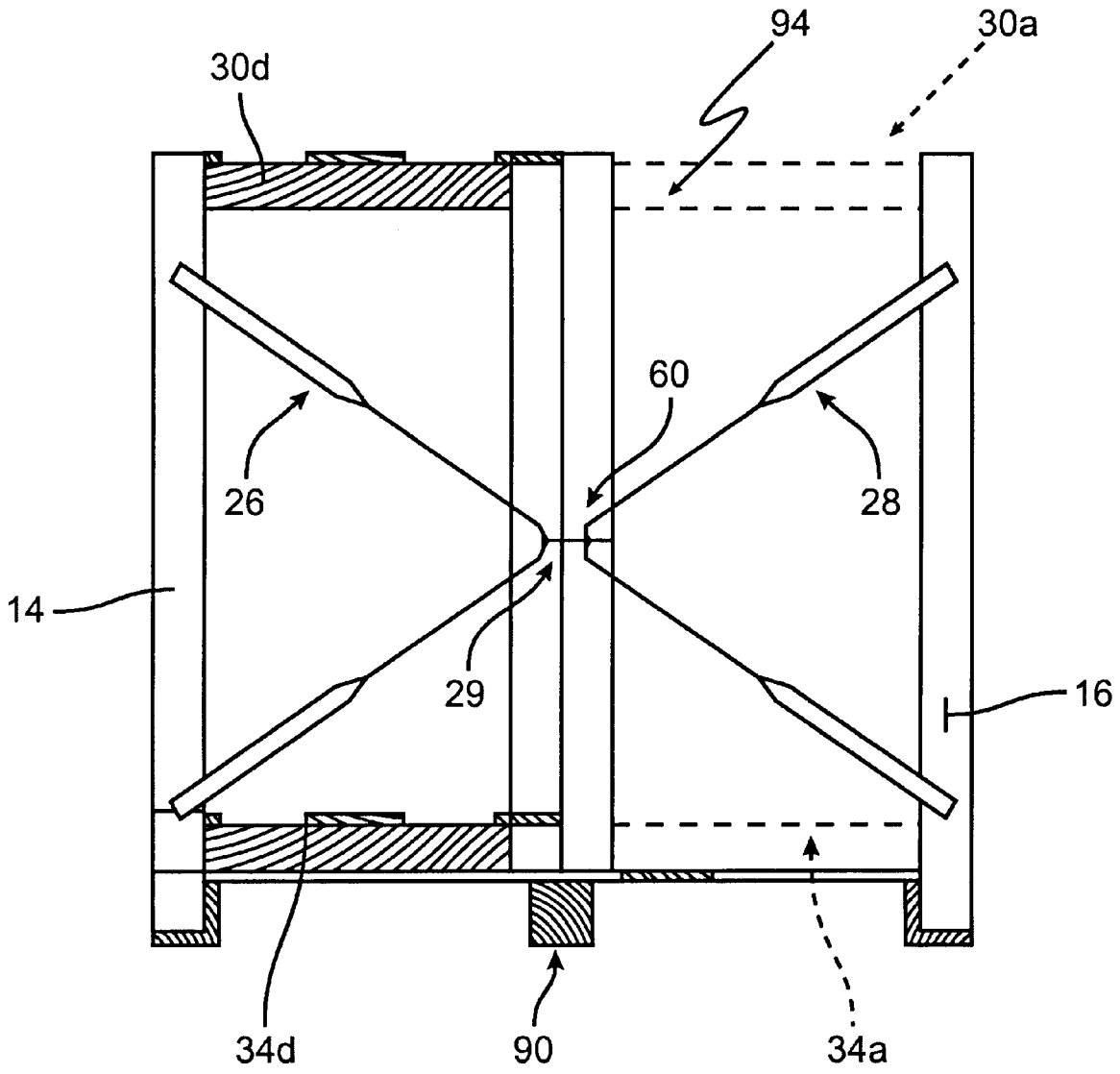
FIG. 28B is another side view of the container assembly of FIG. 27, opposed to the side view of FIG. 28A and illustrating the second connecting and tension assembly (e.g. a second pair of V-shaped brace members plus a second nut and bolt assembly)
Figure 29:
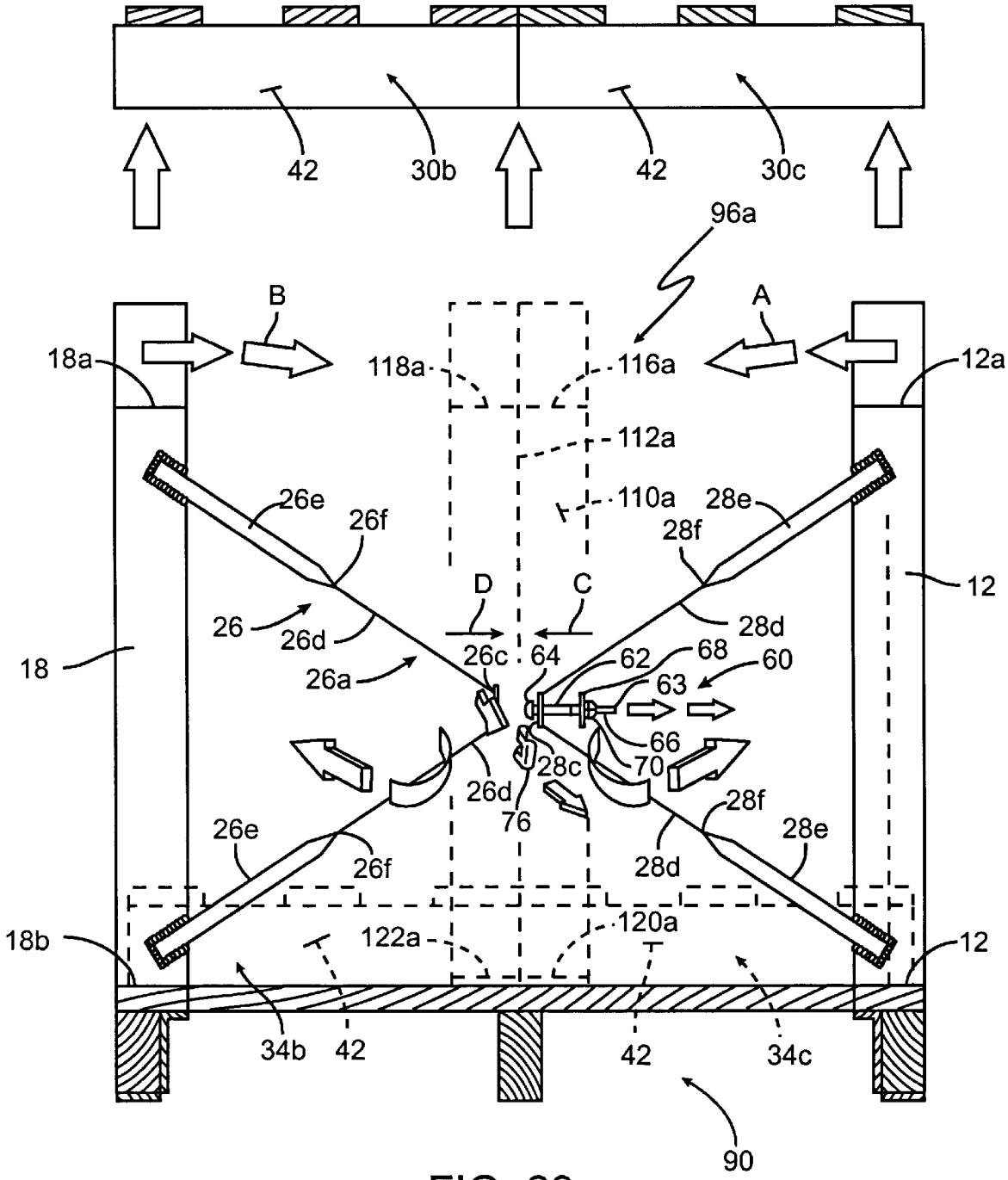
FIG. 29 is a side elevational view of the front of the crate assembly of FIGS. 28 showing the direction of movement of the upper pallets when moved by the fork lift members of the fork lift vehicle, with arrows illustrating the direction of movements of two corner support members towards each other to release tension on the tension brace assemblies such that the nut and bolt assembly may be manually removed from engagement from one of the tension brace assemblies.
Figure 31:
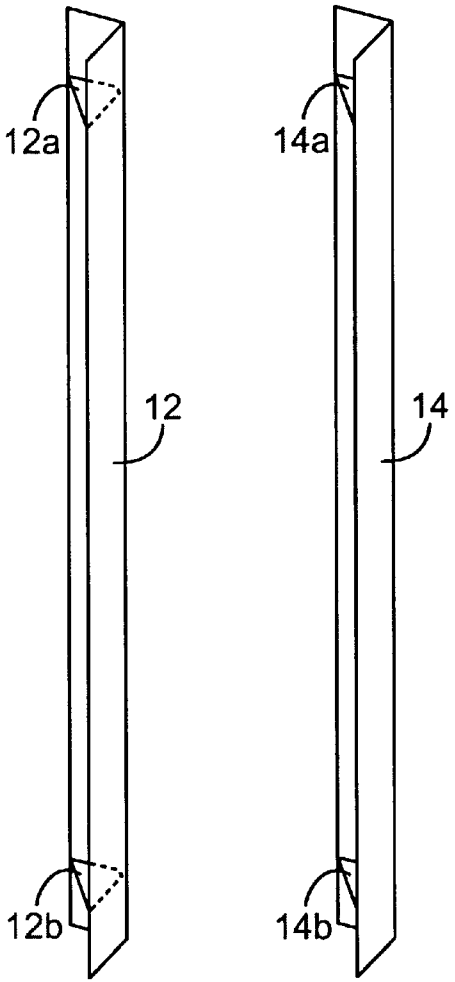
FIG. 31 is a perspective view of the corner support members.
Figure 33:
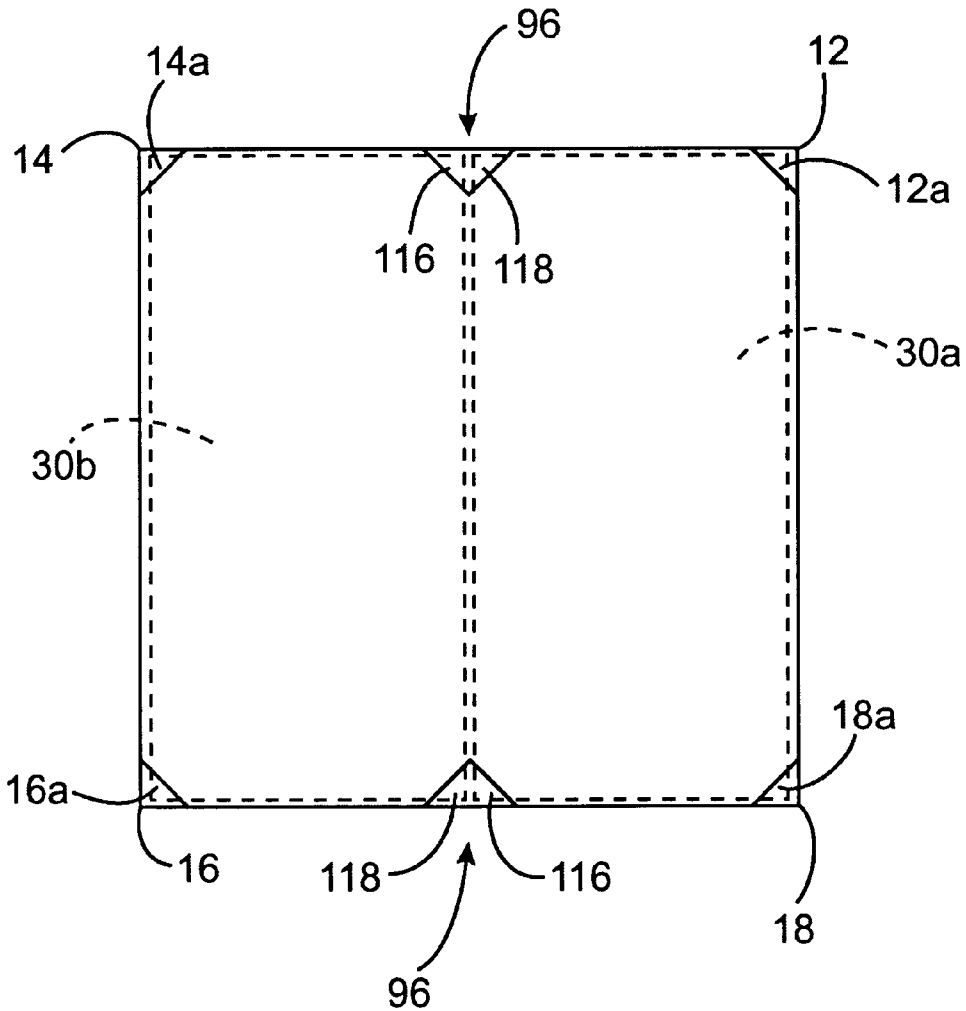
FIG. 33 is a top plan view illustrating two (2) upper or top pallets of another embodiment of the present invention having four corner support members, two opposed intermediate support members, two upper pallets and two lower pallets.
Figure 34:
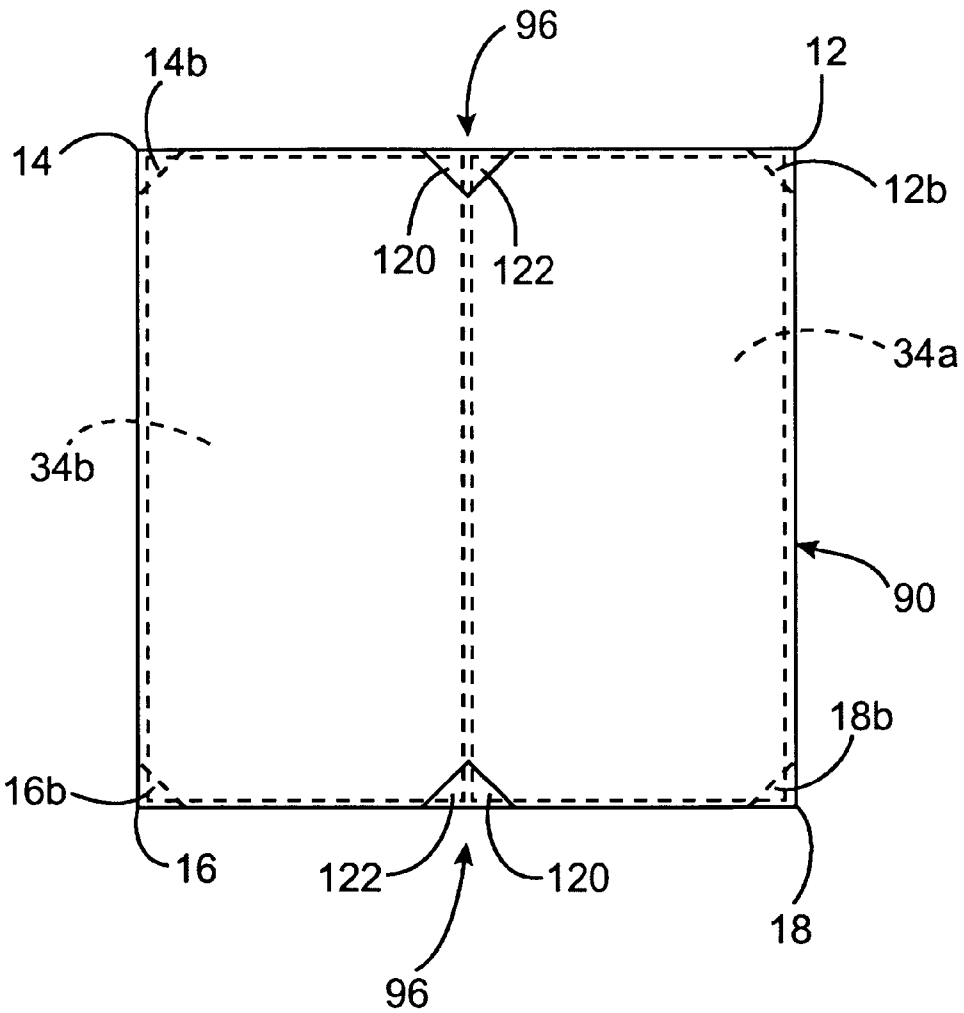
FIG. 34 is a top plan view illustrating the two (2) bottom pallets of the embodiment of the present invention of FIG. 33 having four corner support members, two opposed intermediate support members, two upper pallets and two lower pallets.
Figure 35:
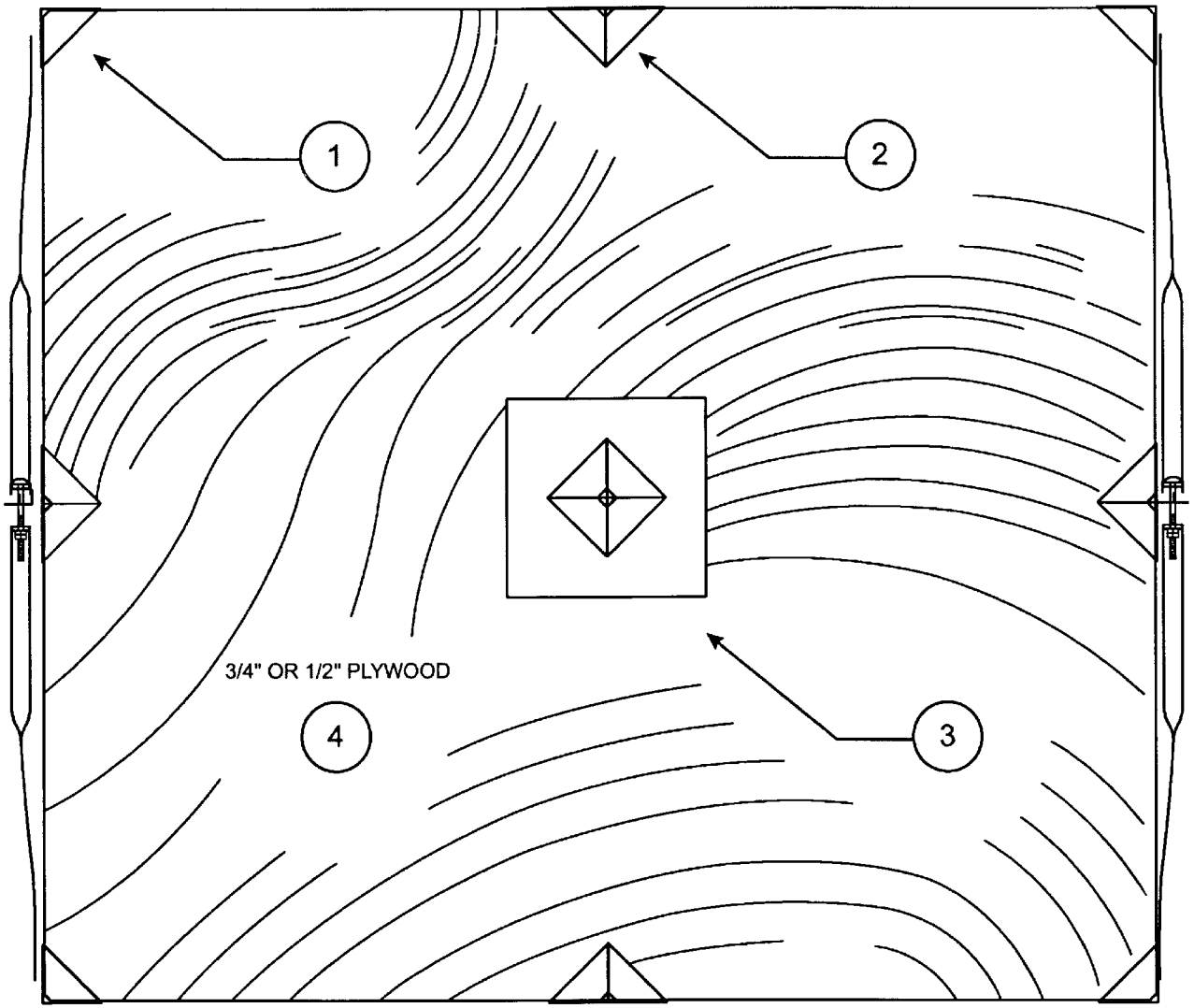
FIG. 35 is a top plan view of the improved crate assembly having a base pallet and disclosing two opposed tension base assemblies.
Figure 36:
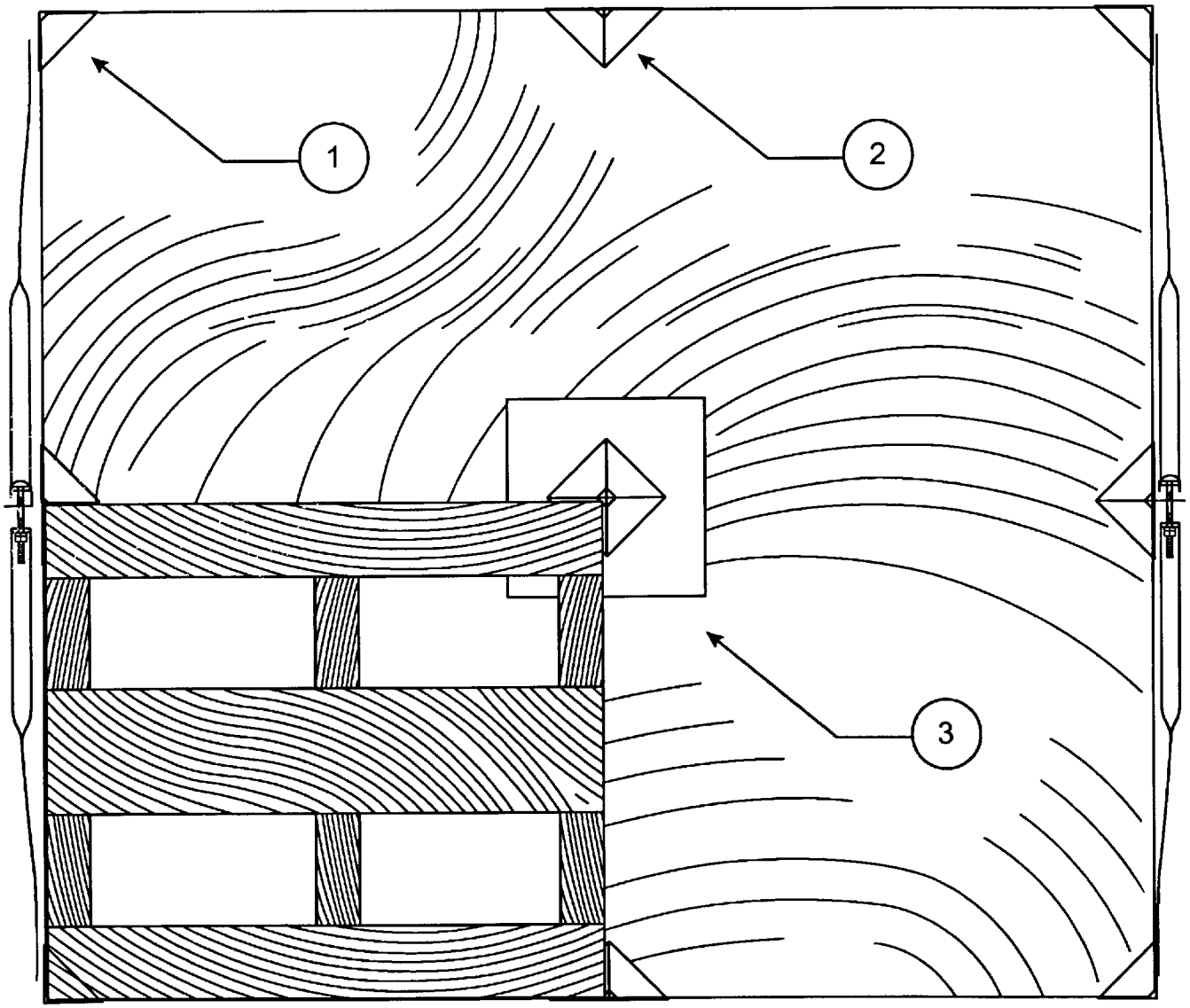
FIG. 36 is another top plan view of the crate assembly of FIG. 35 additionally including a top pallet supported by one of the corner supports, two intermediate support members, and the center support.
Figure 37:
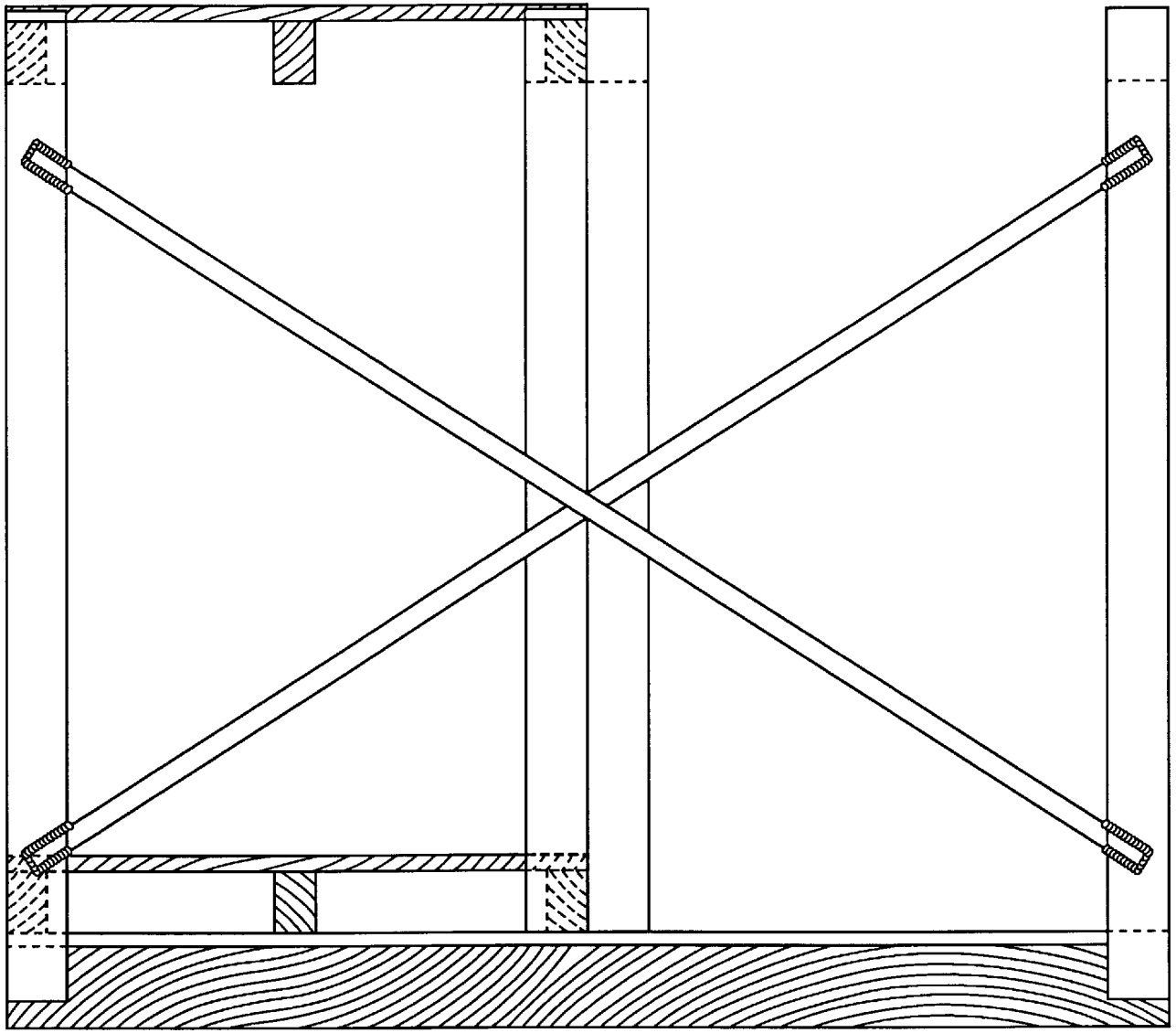
FIG. 37 is an end elevational view of the crate assembly of FIG. 36.
Figure 38:
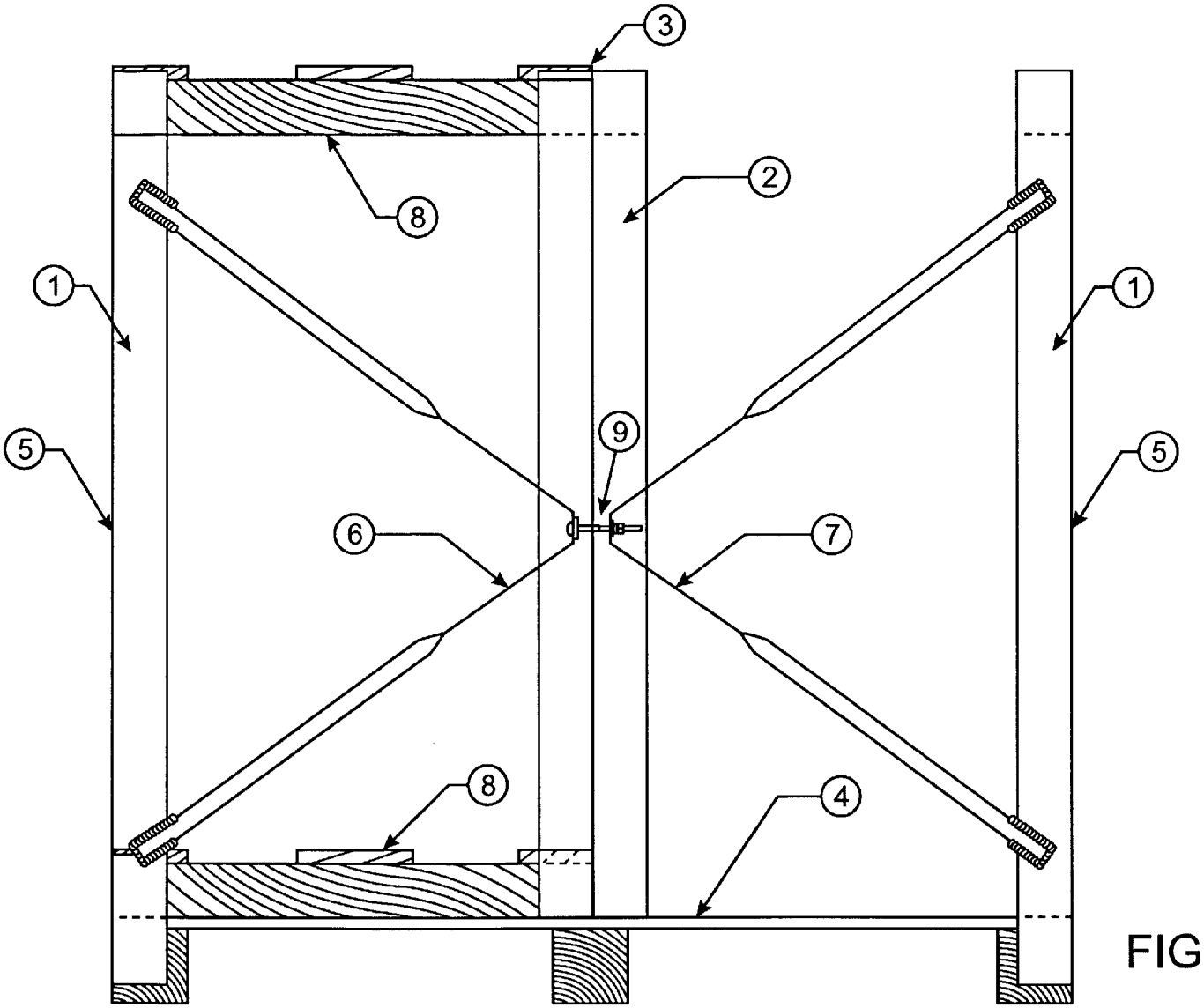
FIG. 38 is a side elevational view of the crate assembly of FIG. 36.
Figure 39:
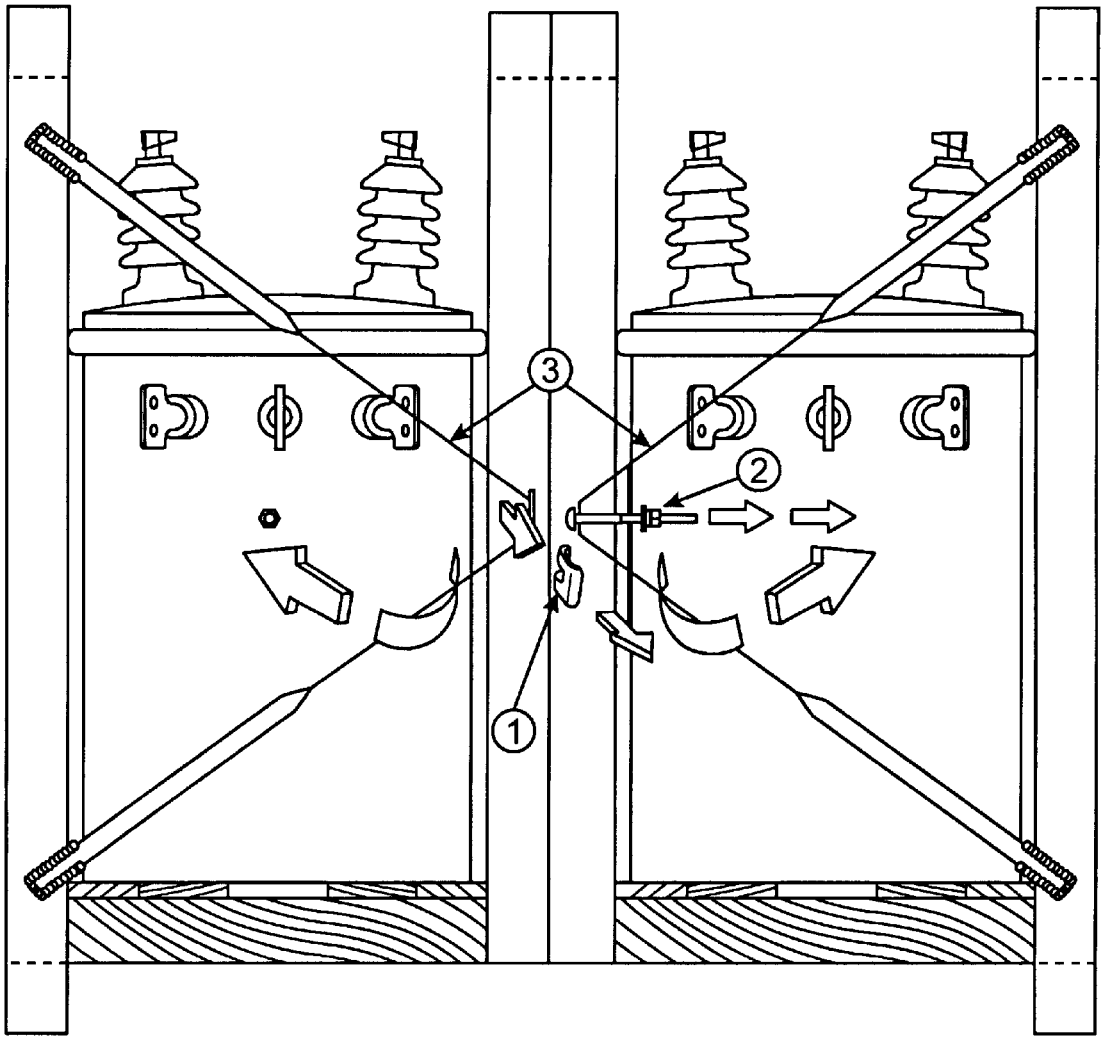
FIG. 39 is another side elevational view of the improved crate assembly disclosing the tension brace assemblies and illustrating the lower or base pallet supporting transformers.
Figure 40:
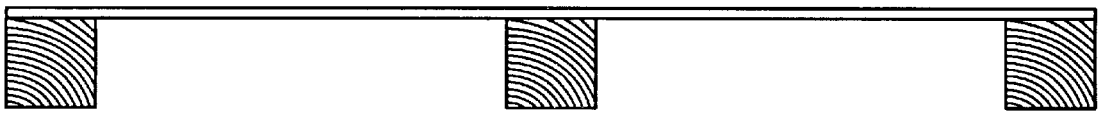
FIG. 40 is a side elevational view of the base or carrier pallet.
Figure 41:
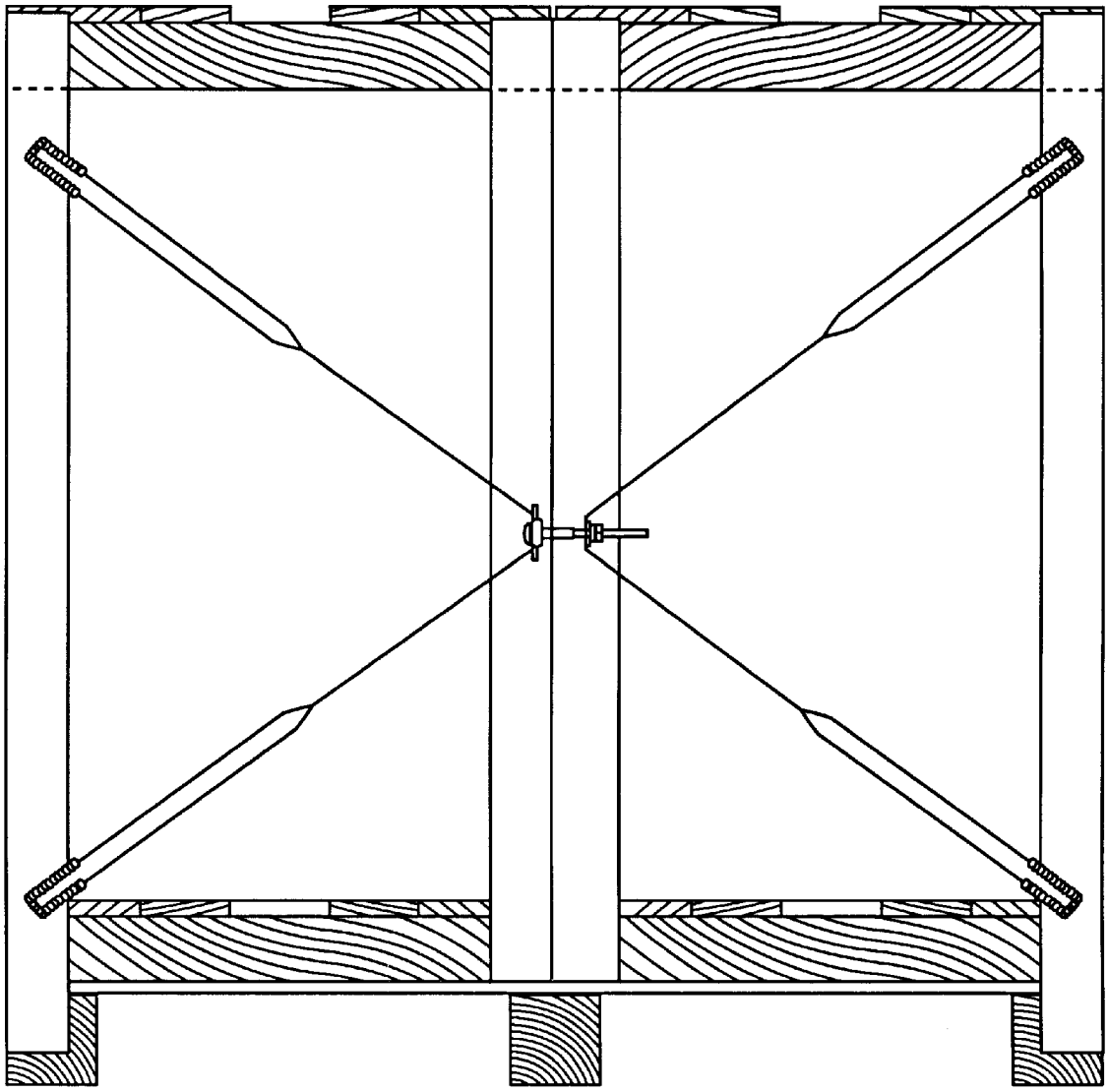
FIG. 41 is a side elevational view of the improved crate assembly in an assembled mode.
Figure 42:
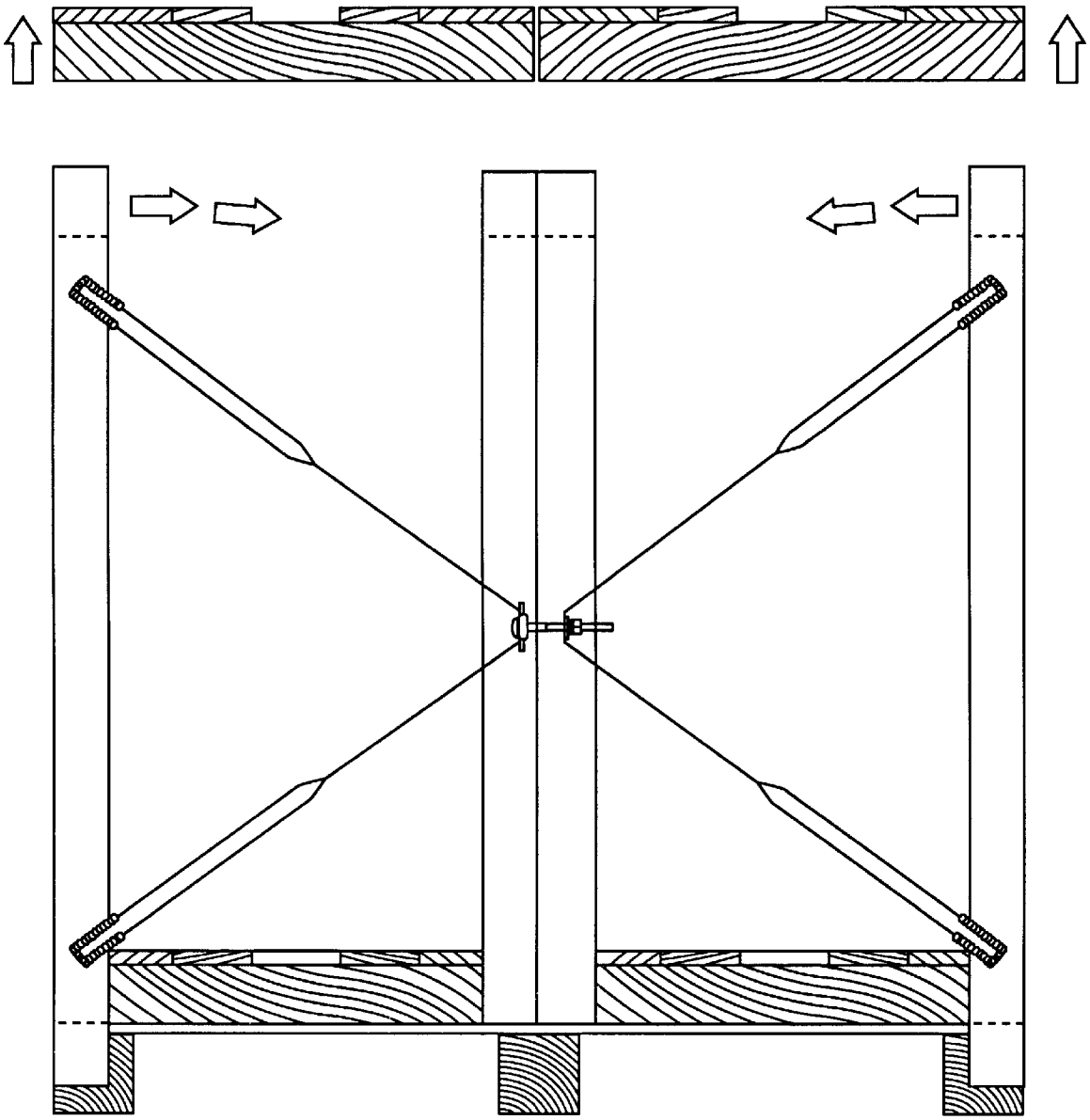
FIG. 42 is a side elevational view of the improved crate assembly of FIG. 41 after the upper pallets were removed.
Figure 43:
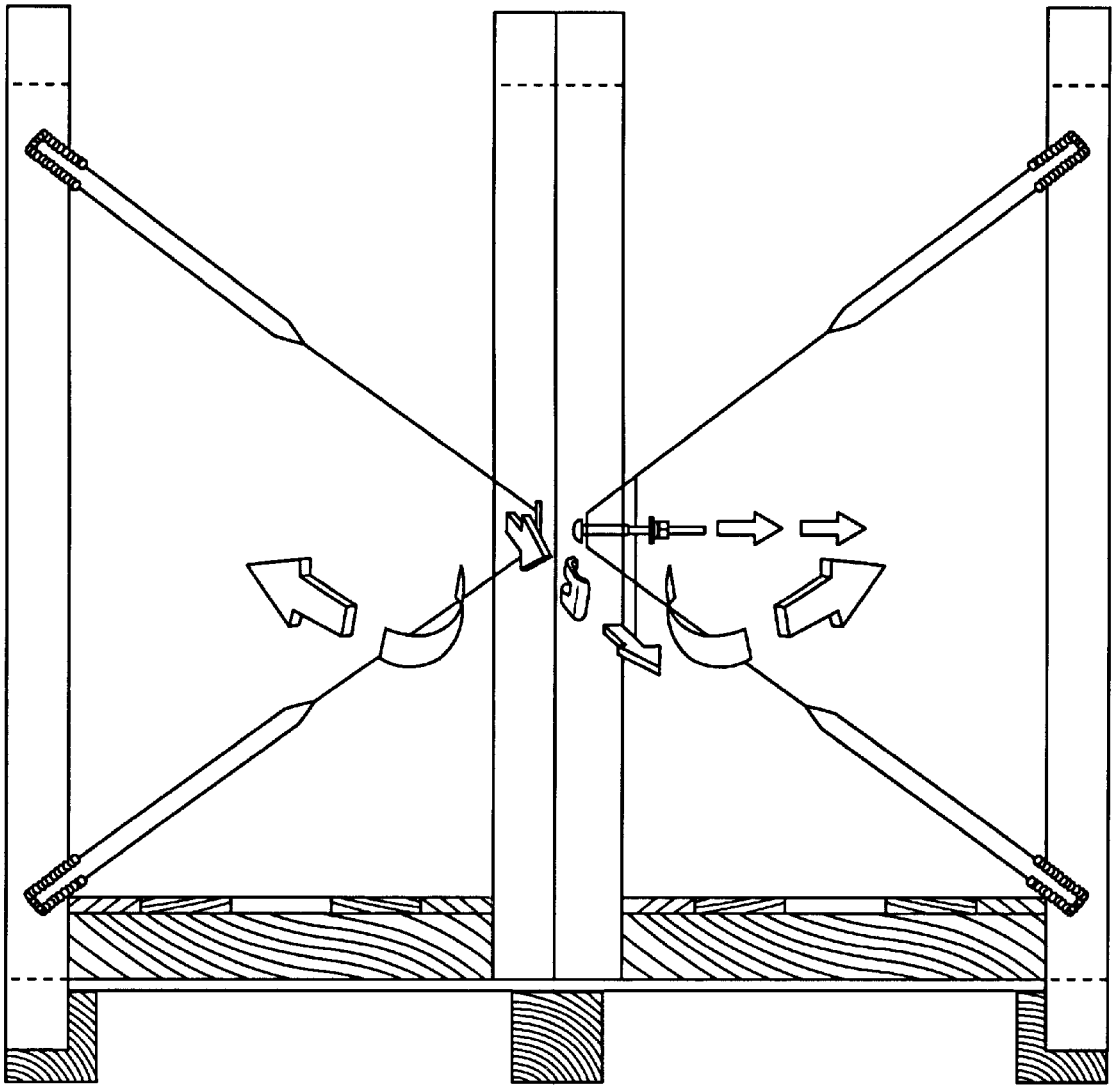
FIG. 43 is a side elevational view of the improved crate assembly after the locking tab has been removed for disconnecting V-braces.
Figure 44:
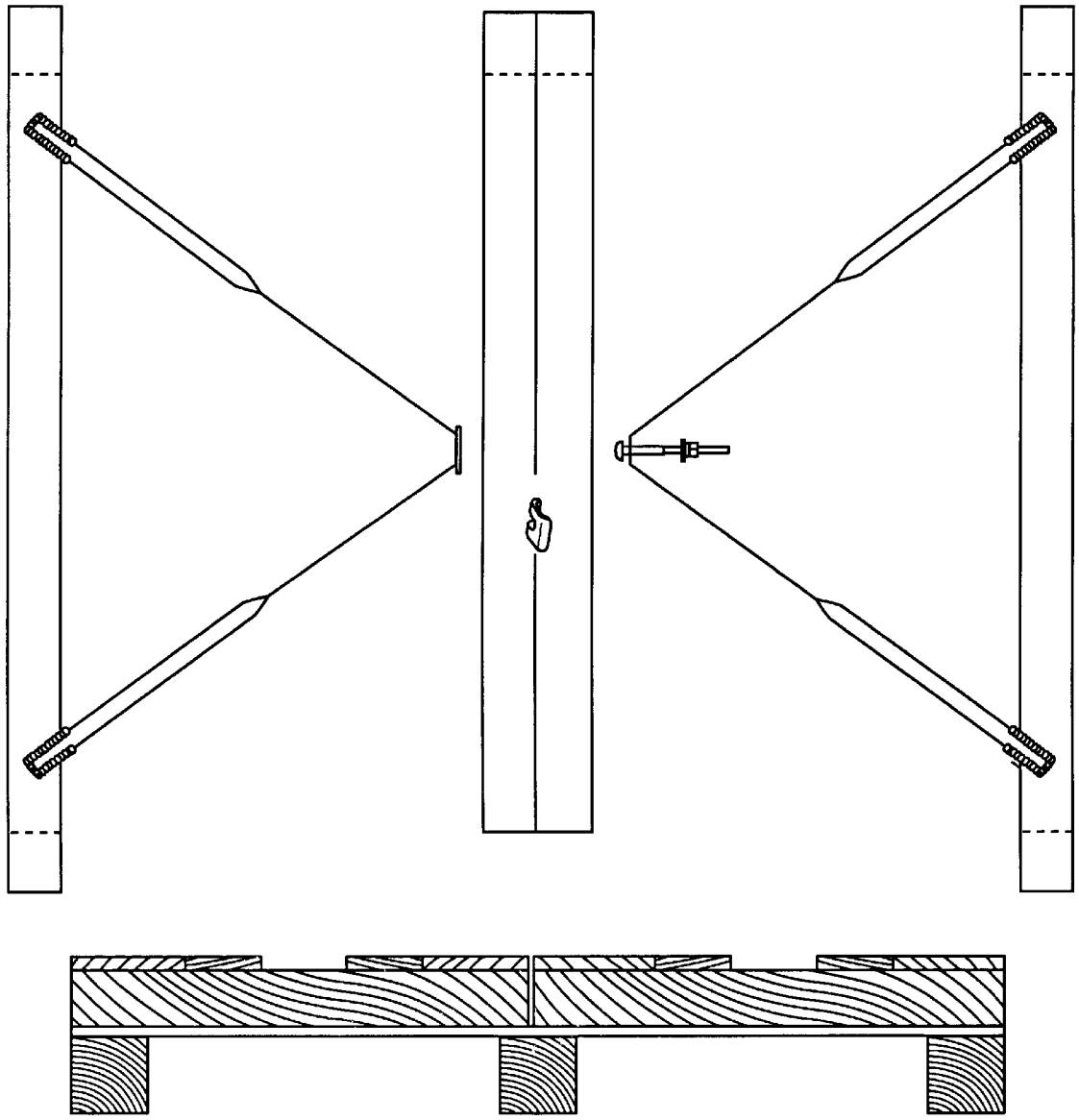
FIG. 44 is a side elevational view of the improved crate assembly after the V-braces were decoupled and all perimeter framing (e.g. the corner supports and the intermediate supports) have been removed.
Figure 45:
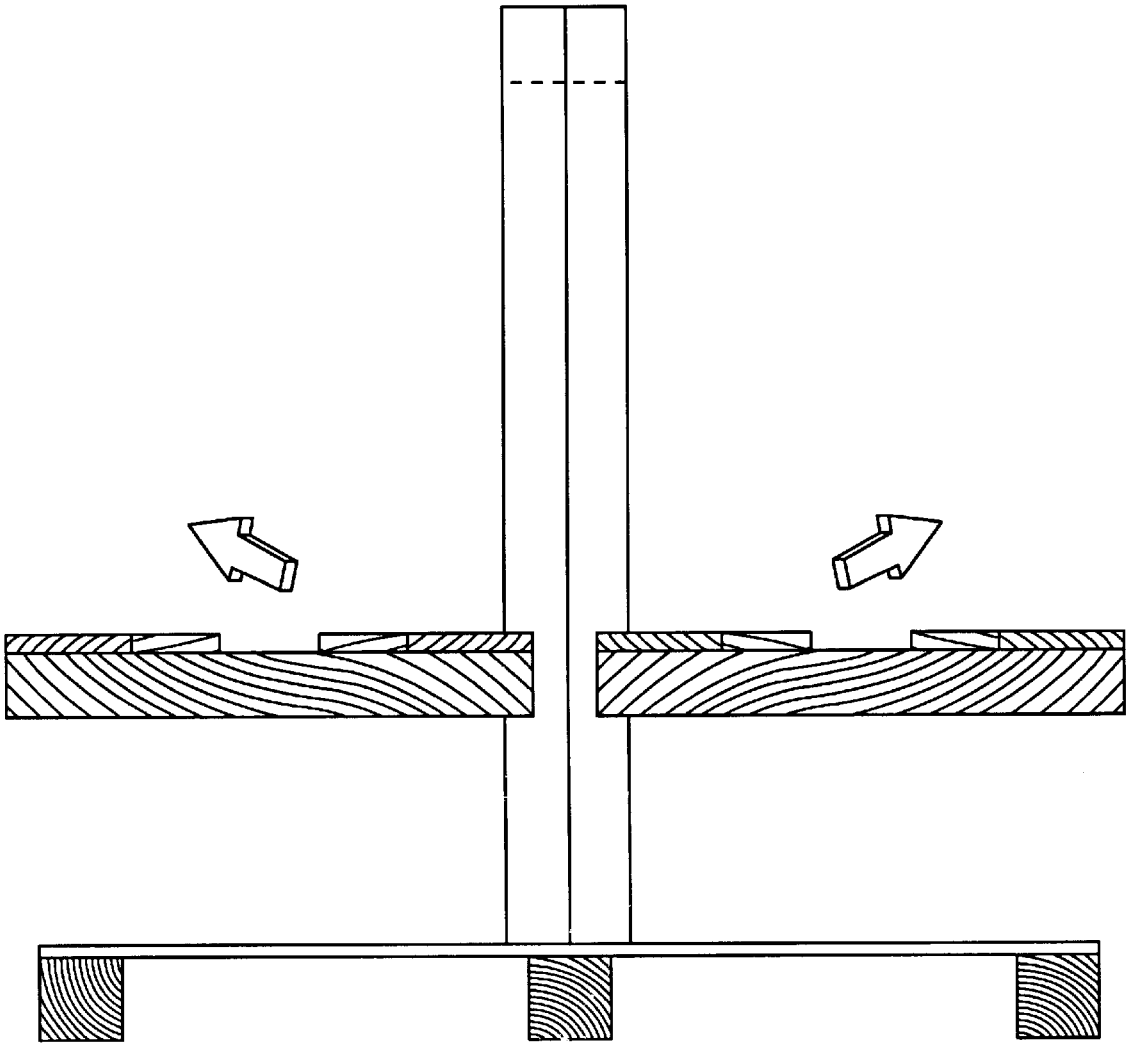
FIG. 45 is a side elevational view of the improved crate assembly illustrating the removal of the bottom transformer pallets, leaving the center post and the base or corner pallet remaining.

Referring now to FIGS. 33 and 34 for the embodiment of the invention which is capable of employing four (4) pallets (i.e. two upper pallets 30*a* and 30*b* and two lower pallets 34*a* and 34*b*), the structure for this embodiment of the invention is similar to the embodiment of the invention of FIGS. 21–32 except there is no center support 94 and only two intermediate supports 96—96 (as opposed to four) are employed. Stated alternatively, this embodiment of the invention includes base 90, the four corner supports 12, 14, 16 and 18 (including respective shelves 12*a*–12*b*, 14*a*–14*b*, 16*a*–16*b*, and 18*a*–18*b*) and intermediate supports 96—96 (as shown in FIG. 32) including upper shelves 116 and 118 for supporting upper pallets 30*a* and 30*b* and lower shelves 120 and 122 for receiving and supporting (along with base 90) lower pallets 34*a* and 34*b*. This embodiment of the invention (as well as the embodiment of the invention in FIGS. 22–32) may include two sets of criss-cross band members (i.e. brace assemblies 20, and 24) as shown in FIGS. 22, 24 and 27 and two sets of tension brace assemblies 26 and 28 and the connecting assembly 29 for each set of tension brace assemblies 26 and 28. Therefore, by way of example only, brace assembly 20 may extend between support members 12 and 14 and brace assembly 24 may extend between support members 16 and 18. Support members 18 and 14 may each have tension brace assembly 26 secured thereto (see FIGS. 28A and 28B), and support members 12 and 16 may each have tension brace assembly 28 secured thereto (see FIGS. 28A and 28B again). A connecting assembly 29 would be employed for each set of brace assembly 26 and 28. Another embodiment of the invention of FIGS. 33 and 34 (as well as the embodiment of the invention in FIGS. 22–32) would be similar to the embodiment of the invention in FIGS. 1–21 and would employ three sets of criss-cross band members (i.e. brace assemblies 20, 22 and 24), one set of tension brace assemblies 26 and 28 and one connecting assembly 29 for one set of tension brace assemblies 26 and 28.

The connecting assembly 29 for the embodiment of the invention in FIGS. 21–34 is the same and operates in the same manner as the connecting assembly 29 for the embodiment of the invention in FIGS. 1–21. More specifically and as previously indicated, the connecting assembly 29 for the embodiment of the invention in FIGS. 22–34 may be any suitable interconnecting assembly that is capable of moving the corner support members 12 and 18 (see FIGS. 28 and 29) towards each other in direction of the arrows A and B, respectively, for compressing and/or "sandwiching" the upper pallets 30*a* and 30*b* therebetween for the embodiment of the invention in FIG. 33 and for compressing and/or "sandwiching" upper pallets 30*a*, 30*b* (including to a certain extent upper pallets 30*c* and 30*d*) therebetween for the embodiment of the invention in FIGS. 22–32, and for placing tension on the tension brace assemblies 26 and 28. Thus, a frictional fit is being produced between the top section of the corner support members 12 and 18 and the upper pallets 30*a* and 30*b* in FIG. 33 and upper pallets 30*a*, 30*b* (including to a certain extent upper pallets 30*c* and 30*d* in FIGS. 22–32). In addition to a frictional fit being produced between the top section of the corner support member 12 and 18 and upper pallets 30*a* and 30*b* in FIG. 33 and upper pallets 30*a*, 30*b* (including to a certain extent upper pallets 30*c* and 30*d*) in FIGS. 22–32, a frictional fit is being produced with, on and long top sections of the corner support members 14 and 16 and intermediate support members 96—96 for the embodiment of the invention in FIGS. 33 and 34, and with, on and along top sections of corner support members 14, 16, intermediate support members 96*a*–96*d*, and top section of center support 94 for the embodiment of the invention in FIGS. 22–32. The connecting assembly 29 is mechanically tightened (e.g. with a wrench, pliers, a screwdriver, etc.) to place the required tension on the tension brace assemblies 26 and 28 in respectively moving the corner support members 12 and 18 in direction of the arrows A and B (e.g. see FIG. 29) and towards each other for frictionally, biasingly engaging the upper pallets (e.g. pallets 30*a* and 30*b* in FIGS. 33 and 34 and pallets 30*a*, 30*b* (including pallets 30*c* and 30*d* to a certain extent) in FIGS. 22–32) with the tops of the corner support members 12 and 18 while the aforementioned upper pallets are being supported by the upper shelves (e.g. shelves 12*a*, 14*a*, 16*a* and 18*a*) of the corner support members 12, 14, 16 and 18, and the upper shelves (e.g., shelves 116 and 118) of intermediate support members 96 for embodiment of the invention in FIGS. 33–34; and, in addition to the foregoing, while the aforementioned upper pallets are being supported by the upper shelves of the center support 94, respectively, for the embodiment of the invention in FIGS. 22–33. While the connecting assembly 29 is being mechanically tightened to bias the corner support members 12 and 18 towards each other and place tension on the tension brace assemblies 26 and 28, the base plates 26*c* and 28*c* of the respective tension brace assemblies 26 and 28 remain spaced apart such that when the top pallets (including its associated articles 32 of commerce) is removed by the fork lift vehicle 100 (e.g. see FIGS. 22 and 29), the corner support members 12 and 18, respectively, move in direction of the arrows A and B (see FIG. 29) and towards each other, causing the two base plates 26*c* and 28*c* of the tension brace assemblies 26 and 28 to also move towards each other (e.g. in direction of the arrows C and D in FIG. 29) such that the connecting assembly 29 becomes a loose fit (or a tensionless engagement) with the two base plates 26*c* and 28*c* and manually operation (i.e. without employment of tools) of the connecting assembly 29 is feasible for decoupling or disengaging the tension brace assemblies 26 and 28 from each other (e.g. see FIGS. 12–15). After the connecting assembly 29 is free from engagement with the base plate 26c and/or base plate 28*c* of the tension brace assemblies 26 and 28, respectively, the tension brace assemblies 26 and 28 may be bent and/or pulled forward and away from the corner support members 18 and 12, respectively (as similarly seen in FIG. 19).

In the embodiment of the invention employing two sets of tension brace assemblies 26 and 28 and a connecting assembly 29 for each set of tension brace assembly 26 and 28, the connecting assembly 29 would be any suitable interconnecting assembly that is capable of moving corner support members 14 and 16 (see FIG. 28B) for compressing and/or "sandwiching" upper pallets 30*a* and 30*b* therebetween for the embodiment of the invention in FIG. 33 and for compressing and/or "sandwiching" upper pallets 30*c* and 30*d* (including to a certain extent upper pallets 30*a* and 30*b*) therebetween for the embodiment of the invention in FIG. 33 and for compressing and/or "sandwiching" upper pallets 30*a*, 30*b* (including to a certain extent upper pallets 30*c* and 30*d*) therebetween for the embodiment of the invention in FIGS. 22–32, and for placing tension on the tension brace assemblies 26 and 28. Thus, a frictional fit is being produced between the top section of the corner support members 14 and 16 and the upper pallets 30*a* and 30*b* in FIG. 33 and upper pallets 30*c*, 30*d* (including to a certain extent upper pallets 30*a* and 30*b*) in FIGS. 22–32. In addition to a frictional fit being produced between the top section of the corner support member 14 and 16 and upper pallets 30*a* and 30*b* in FIG. 33 and upper pallets 30*c*, 30*d* (including to a certain extent upper pallets 30*a* and 30*b*) in FIGS. 22–32, a frictional fit is being produced with, on and long top sections of the corner support members 12 and 18 and intermediate support members 96—96 for the embodiment of the invention in FIGS. 33 and 34, and with, on and along top sections of corner support members 12, 18, intermediate support members 96*a*–96*d*, and top section of center support 94 for the embodiment of the invention in FIGS. 22–32. The connecting assembly 29 is mechanically tightened (e.g. with a wrench, pliers, a screwdriver, etc.) to place the required tension on the tension brace assemblies 26 and 28 in respectively moving the corner support members 14 and 16 towards each other for frictionally, biasingly engaging the upper pallets (e.g. pallets 30*a* and 30*b* in FIGS. 33 and 34 and pallets 30*c*, 30*d* (including pallets 30*a* and 30*b* to a certain extent) in FIGS. 22–32) with the tops of the corner support members 14 and 16 while the aforementioned upper pallets are being supported by the upper shelves (e.g. shelves 12*a*, 14*a*, 16*a* and 18*a*) of the corner support members 12, 14, 16 and 18, and the upper shelves (e.g., shelves 116 and 118) of intermediate support members 96 for embodiment of the invention in FIGS. 33–34; and, in addition to the foregoing, while the aforementioned upper pallets are being supported by the upper shelves of the center support 94, respectively, for the embodiment of the invention in FIGS. 22–33. While the connecting assembly 29 is being mechanically tightened to bias the corner support members 14 and 16 towards each other and place tension on the tension brace assemblies 26 and 28, the base plates 26*c* and 28*c* of the respective tension brace assemblies 26 and 28 remain spaced apart such that when the top pallets (including its associated articles 32 of commerce) is removed by the fork lift vehicle 100 (e.g. see FIGS. 22 and 29), the corner support members 14 and 16, respectively, move towards each other, causing the two base plates 26*c* and 28*c* of the tension brace assemblies 26 and 28 to also move towards each other such that the connecting assembly 29 becomes a loose fit (or a tensionless engagement) with the two base plates 26*c* and 28*c* and manually operation (i.e. without employment of tools) of the connecting assembly 29 is feasible for decoupling or disengaging the tension brace assemblies 26 and 28 from each other. After the connecting assembly 29 is free from engagement with the base plate 26*c* and/or base plate 28*c* of the tension brace assemblies 26 and 28, respectively, the tension brace assemblies 26 and 28 may be bent and/or pulled forward and away from the corner support members 14 and 16, respectively (as similarly seen in FIG. 19).

Thus, while the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

What is claimed is:

1. A container assembly comprising a base; a first support member secured to said base and having a structure defining a first shelf; a second support member secured to said base and having a structure defining a second shelf; a third support member secured to said base and having a structure defining a third shelf; a fourth support member secured to said base and having a structure defining a fourth shelf; a generally centric support member secured to said base and having a structure defining at least one generally centric shelf; a first brace member connected to the first support member; a second brace member connected to the second support member; a third brace member connected to the third support member; a fourth brace member connected to the fourth support member; and a first connector assembly releasably attached to the first brace member and to the second brace member for placing tension on the first brace member and on the second brace member; a second connector assembly releasably attached to the third brace member and the fourth brace member for placing tension on the third brace member and on the fourth brace member; and a pallet supported by said base.

2. The container assembly of claim 1 additionally comprising at least one intermediate support member secured to said base and having a structure defining at least one intermediate shelf.

3. The container assembly of claim 1 wherein said pallet supported by said base comprises said pallet disposed on one of said first, second, third and fourth shelves and on one of said at least one generally centric shelf.

4. The container assembly of claim 1 wherein said pallet supported by said base comprises said pallet disposed on said base.

5. The container assembly of claim 2 wherein said pallet supported by said base comprises said pallet disposed on one of said first, second, third and fourth shelves and on one of said at least one generally centric shelf.

6. The container assembly of claim 2 wherein said pallet supported by said base comprises said pallet disposed on said base.

7. The container assembly of claim 1 wherein said generally centric support member includes said structure defining a first centric shelf, a second centric shelf, a third centric shelf, and a fourth centric shelf.

8. The container assembly of claim 2 wherein said generally centric support member includes said structure defining a first centric shelf, a second centric shelf, a third centric shelf, and a fourth centric shelf.

9. The container assembly of claim 1 additionally comprising a first intermediate support member secured to said base between said first support member and between said second support member, a second intermediate support member secured to said base between said second support member and said third support member, a third support member secured to said base between said third support member and said fourth support member, and a fourth support member secured to said base between said fourth support member and said first support member.

10. The container assembly of claim 9 wherein said first intermediate support member comprises a first upper intermediate shelf.

11. The container assembly of claim 10 wherein said pallet supported by said base comprises said pallet disposed on said first upper intermediate shelf of said intermediate support member and on said first shelf of said first support member and on said generally centric shelf of said generally centric support member.

12. The container assembly of claim 9 wherein said first intermediate support member comprises a first lower intermediate shelf, and said second intermediate support member comprises a second lower intermediate shelf.

13. The container assembly of claim 12 wherein said pallet supported by said base comprises said pallet disposed on said first lower intermediate shelf of said intermediate support member and on said second lower intermediate shelf of said second intermediate support member and on said base.

14. A crate assembly comprising a base, a first support member secured to said base and having a structure defining a first shelf; a second support member secured to said base and having a structure defining a second shelf; a third support member secured to said base and having a structure defining a third shelf; a fourth support member secured to said base and having a structure defining a fourth shelf; a generally centric support member secured to said base and having a structure defining at least one generally centric shelf, a first brace assembly connected to the first support member; a second brace assembly connected to the second support member; and a connector, releasably attached to the first brace assembly and to the second brace assembly for placing tension on the first brace assembly and on the second brace assembly.

15. The crate assembly of claim 14 additionally comprising at least one intermediate support member secured to said base and having a structure defining at least one intermediate shelf.

16. A method for transporting transformers comprising the steps of:

a) providing a pallet;

b) providing a crate assembly having a first support member with a first shelf and a first tension brace assembly connected thereto, a second support member with a second tension brace assembly connected thereto, a generally centric support member having a centric shelf and an intermediate support member having an intermediate shelf;

c) positioning a transformer on the pallet;

d) disposing the pallet on the first shelf of the first support member, on the centric shelf of the generally centric support member, and on the intermediate shelf of the intermediate support member;

e) placing tension on the first tension brace assembly and on the second tension brace assembly while simultaneously compressing the pallet of step (d) between the first support member and the intermediate support member to form a container assembly comprising the pallet and the transformer positioned on the pallet; and f) transporting the container assembly of step (e) to a desired destination.

17. A crate assembly comprising a base, a first support member secured to said base and having a structure defining a first shelf; a second support member secured to said base and having a structure defining a second shelf; a third support member secured to said base and having a structure defining a third shelf; a fourth support member secured to said base and having a structure defining a fourth shelf; at least one intermediate support member secured to said base and having a structure defining at least one intermediate shelf; and a first brace assembly connected to the first support member; a second brace assembly connected to the second support member; and a connector, releasably attached to the first brace assembly and to the second brace assembly for placing tension on the first brace assembly and on the second brace assembly.

* * * * *